US011162050B2

(12) United States Patent
Hayakawa et al.

(10) Patent No.: US 11,162,050 B2
(45) Date of Patent: Nov. 2, 2021

(54) LUBRICATING OIL COMPOSITION, VISCOSITY MODIFIER FOR LUBRICATING OIL, AND ADDITIVE COMPOSITION FOR LUBRICATING OIL

(71) Applicant: MITSUI CHEMICALS, INC., Tokyo (JP)

(72) Inventors: Akio Hayakawa, Kawasaki (JP); Shuhei Yamamoto, Ichihara (JP); Takayuki Uekusa, Ichihara (JP); Ikuko Ebisawa, Chiba (JP); Masahiro Yamashita, Chiba (JP); Toyoaki Sasaki, Narashino (JP)

(73) Assignee: MITSUI CHEMICALS, INC., Tokyo (JP)

( * ) Notice: Subject to any disclaimer, the term of this patent is extended or adjusted under 35 U.S.C. 154(b) by 129 days.

(21) Appl. No.: 16/473,399

(22) PCT Filed: Dec. 26, 2017

(86) PCT No.: PCT/JP2017/046641

§ 371 (c)(1),
(2) Date: Jun. 25, 2019

(87) PCT Pub. No.: WO2018/124070

PCT Pub. Date: Jul. 5, 2018

(65) Prior Publication Data

US 2020/0140776 A1 May 7, 2020

(30) Foreign Application Priority Data

Dec. 27, 2016 (JP) ..... JP2016-253401
Feb. 10, 2017 (JP) ..... JP2017-023079

(51) Int. Cl.

| | |
|---|---|
| ***C10M 143/08*** | (2006.01) |
| ***C10M 169/04*** | (2006.01) |
| *C10N 30/00* | (2006.01) |
| *C10N 20/02* | (2006.01) |
| *C10N 20/04* | (2006.01) |
| *C10N 30/02* | (2006.01) |
| *C10N 30/04* | (2006.01) |
| *C10N 40/25* | (2006.01) |

(52) U.S. Cl.

CPC ..... *C10M 143/08* (2013.01); *C10M 169/041* (2013.01); *C10M 2205/028* (2013.01); *C10M 2290/02* (2013.01); *C10M 2290/04* (2013.01); *C10N 2020/02* (2013.01); *C10N 2020/04* (2013.01); *C10N 2030/02* (2013.01); *C10N 2030/04* (2013.01); *C10N 2030/68* (2020.05); *C10N 2040/25* (2013.01)

(58) Field of Classification Search

CPC ..... C10M 2290/04; C10M 2205/028; C10M 143/08; C10M 169/041; C10M 2290/02; C10N 2020/02; C10N 2030/02

See application file for complete search history.

(56) References Cited

U.S. PATENT DOCUMENTS

| | | | |
|---|---|---|---|
| 2,501,731 | A | 3/1950 | Mertes |
| 2,616,905 | A | 11/1952 | Asseff et al. |
| 2,616,911 | A | 11/1952 | Asseff et al. |
| 2,616,925 | A | 11/1952 | Asseff et al. |
| 2,777,874 | A | 1/1957 | Asseff et al. |
| 3,076,764 | A | 2/1963 | Hansen et al. |
| 3,090,821 | A | 5/1963 | Voltz |
| 3,172,892 | A | 3/1965 | Le Suer et al. |
| 3,256,186 | A | 6/1966 | Greenwald |
| 3,265,622 | A | 8/1966 | Anderson |
| 3,318,809 | A | 5/1967 | Bray |
| 3,320,162 | A | 5/1967 | Axe et al. |
| 3,365,396 | A | 1/1968 | Schlicht |
| 3,381,022 | A | 4/1968 | Le Suer |
| 3,384,585 | A | 5/1968 | Gragson et al. |
| 3,488,284 | A | 1/1970 | LeSuer et al. |
| 3,629,109 | A | 12/1971 | Gergel et al. |
| 3,634,515 | A | 1/1972 | Piasek et al. |
| 4,076,924 | A | 2/1978 | Toyota et al. |

(Continued)

FOREIGN PATENT DOCUMENTS

| | | | | |
|---|---|---|---|---|
| EP | 2311914 | A1 * | 4/2011 | ..... B32B 27/365 |
| GB | 1057716 | A | 2/1967 | |
| GB | 1124016 | A | 8/1968 | |
| JP | S50-108385 | A | 8/1975 | |
| JP | S50-126590 | A | 10/1975 | |
| JP | S51-20297 | A | 2/1976 | |
| JP | S51-28189 | A | 3/1976 | |
| JP | S51-64586 | A | 6/1976 | |

(Continued)

OTHER PUBLICATIONS

Extended European Search Report dated Aug. 4, 2020 for corresponding European Patent Application No. 17888281.7.

(Continued)

*Primary Examiner* — Ellen M Mcavoy
*Assistant Examiner* — Ming Cheung Po
(74) *Attorney, Agent, or Firm* — Foley & Lardner LLP

(57) ABSTRACT

An object of the present invention is to provide a lubricating oil composition particularly excellent in viscosity characteristics at a low temperature. The present invention provides: a lubricating oil composition including a polymer (A) and a base oil (B), wherein the polymer (A) satisfies the following requirement (A-1), and the content ratio of the polymer (A) and the base oil (B) is such that the ratio of a resin (A) is within the range of from 0.1 to 50 parts by mass with respect to 100 parts by mass of the total amount of the polymer (A) and the base oil (B). (A-1) The polymer (A) is a polymer containing a structural unit derived from an α-olefin having 20 or less carbon atoms.

19 Claims, No Drawings

(56) References Cited

U.S. PATENT DOCUMENTS

| | | | | |
|---|---|---|---|---|
| 4,085,276 | A | 4/1978 | Toyota et al. | |
| 4,143,223 | A | 3/1979 | Toyota et al. | |
| 4,157,435 | A | 6/1979 | Toyota et al. | |
| 4,232,139 | A | 11/1980 | Minami et al. | |
| 4,234,435 | A | 11/1980 | Meinhardt et al. | |
| 4,250,285 | A | 2/1981 | Minami et al. | |
| 4,285,822 | A | 8/1981 | deVries et al. | |
| 4,315,874 | A | 2/1982 | Ushida et al. | |
| 4,330,649 | A | 5/1982 | Kioka et al. | |
| 4,335,015 | A | 6/1982 | Imai et al. | |
| 4,401,589 | A | 8/1983 | Kioka et al. | |
| 4,490,513 | A | 12/1984 | Minami et al. | |
| 4,654,403 | A | 3/1987 | Tipton | |
| 4,742,139 | A | 5/1988 | Kioka et al. | |
| 4,892,851 | A | 1/1990 | Ewen et al. | |
| 4,952,649 | A | 8/1990 | Kioka et al. | |
| 5,036,034 | A | 7/1991 | Ewen | |
| 5,155,080 | A | 10/1992 | Elder et al. | |
| 5,158,920 | A | 10/1992 | Razavi | |
| 5,162,278 | A | 11/1992 | Razavi | |
| 5,223,467 | A | 6/1993 | Razavi | |
| 5,223,468 | A | 6/1993 | Razavi | |
| 5,225,500 | A | 7/1993 | Elder et al. | |
| 5,243,002 | A | 9/1993 | Razavi | |
| 5,278,265 | A | 1/1994 | Razavi | |
| 5,292,838 | A | 3/1994 | Razavi | |
| 5,304,523 | A | 4/1994 | Razavi | |
| 5,334,677 | A | 8/1994 | Razavi et al. | |
| 5,561,092 | A | 10/1996 | Ewen et al. | |
| 5,583,188 | A | 12/1996 | Kashiwa et al. | |
| 5,589,556 | A | 12/1996 | Razavi | |
| 5,763,549 | A | 6/1998 | Elder et al. | |
| 5,807,939 | A | 9/1998 | Elder et al. | |
| 5,883,202 | A | 3/1999 | Ewen et al. | |
| 6,200,936 | B1 | 3/2001 | Moreton | |
| 6,310,009 | B1 | 10/2001 | Kocsis et al. | |
| 6,369,175 | B1 | 4/2002 | Ewen | |
| 6,399,549 | B1 | 6/2002 | Taylor et al. | |
| 6,417,120 | B1 | 7/2002 | Mitchler et al. | |
| 6,559,105 | B2 | 5/2003 | Abraham et al. | |
| 6,939,928 | B1 | 9/2005 | Kawai et al. | |
| 7,589,145 | B2 * | 9/2009 | Brant | C09J 123/10 524/515 |
| 7,803,888 | B2 * | 9/2010 | Kawahara | C08F 210/14 526/170 |
| 8,921,291 | B2 * | 12/2014 | Wu | C08F 210/00 508/591 |
| 10,040,884 | B2 * | 8/2018 | Harada | C10M 177/00 |
| 2002/0035044 | A1 | 3/2002 | Okada et al. | |
| 2002/0055445 | A1 | 5/2002 | Okada et al. | |
| 2002/0107153 | A1 | 8/2002 | Taylor et al. | |
| 2002/0155776 | A1 | 10/2002 | Mitchler et al. | |
| 2003/0055179 | A1 | 3/2003 | Ota et al. | |
| 2005/0228155 | A1 | 10/2005 | Kawai et al. | |
| 2006/0199896 | A1 * | 9/2006 | Walton | C08L 23/0815 524/543 |
| 2007/0249508 | A1 | 10/2007 | Matsuda et al. | |
| 2008/0125561 | A1 | 5/2008 | Matsuda et al. | |
| 2009/0023619 | A1 | 1/2009 | Kaneshige et al. | |
| 2012/0190601 | A1 | 7/2012 | Ikeda et al. | |
| 2013/0052464 | A1 | 2/2013 | Kawabe et al. | |
| 2015/0239996 | A1 | 8/2015 | Funaya et al. | |
| 2016/0376385 | A1 | 12/2016 | Funaya et al. | |
| 2017/0327610 | A1 | 11/2017 | Funaya et al. | |
| 2017/0327611 | A1 | 11/2017 | Funaya et al. | |

FOREIGN PATENT DOCUMENTS

| | | | |
|---|---|---|---|
| JP | S51-92885 | A | 8/1976 |
| JP | S51-136625 | A | 11/1976 |
| JP | S52-87489 | A | 7/1977 |
| JP | S52-100596 | A | 8/1977 |
| JP | S52-104593 | A | 9/1977 |
| JP | S52-147688 | A | 12/1977 |
| JP | S53-2580 | A | 1/1978 |
| JP | S53-40093 | A | 4/1978 |
| JP | S53-43094 | A | 4/1978 |
| JP | S55-135102 | A | 10/1980 |
| JP | S55-135103 | A | 10/1980 |
| JP | S56-811 | A | 1/1981 |
| JP | S56-11908 | A | 2/1981 |
| JP | S56-18606 | A | 2/1981 |
| JP | S58-83006 | A | 5/1983 |
| JP | S58-138705 | A | 8/1983 |
| JP | S58-138706 | A | 8/1983 |
| JP | S58-138707 | A | 8/1983 |
| JP | S58-138708 | A | 8/1983 |
| JP | S58-138709 | A | 8/1983 |
| JP | S58-138710 | A | 8/1983 |
| JP | S58-138715 | A | 8/1983 |
| JP | S63-57615 | A | 3/1988 |
| JP | H02-41303 | A | 2/1990 |
| JP | H03-193796 | A | 8/1991 |
| JP | H07-25844 | B2 | 3/1995 |
| JP | 2003-105365 | A | 4/2003 |
| JP | 5798113 | B2 | 10/2015 |
| WO | WO-00/34420 | A1 | 6/2000 |
| WO | WO-00/60032 | A1 | 10/2000 |
| WO | WO-01/27124 | A1 | 4/2001 |
| WO | WO-01/53369 | A1 | 7/2001 |
| WO | WO-01/56968 | A1 | 8/2001 |
| WO | WO-2006/109631 | A1 | 10/2006 |
| WO | WO-2008/047878 | A1 | 4/2008 |
| WO | WO-2014/050817 | A1 | 4/2014 |

OTHER PUBLICATIONS

International Searching Authority, "International Search Report," issued in connection with International Patent Application No. PCT/JP2017/046641, dated Mar. 6, 2018.

International Searching Authority, "Written Opinion," issued in connection with International Patent Application No. PCT/JP2017/046641, dated Mar. 6, 2018.

* cited by examiner

LUBRICATING OIL COMPOSITION, VISCOSITY MODIFIER FOR LUBRICATING OIL, AND ADDITIVE COMPOSITION FOR LUBRICATING OIL

RELATED APPLICATIONS

The present application claims priority under 37 U.S.C. § 371 to International Patent Application No. PCT/JP2017/046641, filed Dec. 26, 2017, which claims priority to and the benefit of Japanese Patent Application Nos. 2016-253401, filed on Dec. 27, 2016, and 2017-023079, filed on Feb. 10, 2017. The contents of these applications are hereby incorporated by reference in their entireties.

TECHNICAL FIELD

The present invention relates to a lubricating oil composition which satisfies specific requirements, a viscosity modifier for lubricating oils excellent in storage stability under low temperature conditions as well as in viscosity characteristics at a low temperature, and an additive composition for lubricating oils obtained therefrom.

BACKGROUND ART

Petroleum products generally have a so-called temperature dependence of viscosity; in other words, they show a large variation in viscosity depending on the temperature. Lubricating oil compositions for use in automobiles and the like, for example, preferably have a low temperature dependence of viscosity. Therefore, in order to reduce the temperature dependence of viscosity, a certain kind of polymer which is soluble in a lubricating oil base is used in a lubricating oil as a viscosity modifier.

Ethylene/α-olefin copolymers have been widely used as such a viscosity modifier for lubricating oils, and modified in various ways to further improve the balance between the properties of lubricating oils (see Patent Document 1, for example).

With growing concerns for decreasing petroleum resources and environmental problems such as global warming in recent years, improvements in automobile fuel efficiency are demanded in order to reduce exhaust gas pollutants and $CO_2$ emissions. Fuel saving by improving lubricating oils has been expected as an important technique for saving fuel, because of its superiority in cost-effectiveness as compared to improving the physical structure of lubricating devices, and demands for improvements in fuel efficiency by lubricating oils are increasing.

Power loss in engines and transmissions can be categorized into two types: friction loss at sliding portions; and agitation loss due to the viscosity of lubricating oils. In particular, one of the measures for saving fuel by engine oils is to reduce the viscous resistance of engine oils. As is evident from the fact that measurements under relatively low temperature conditions have been added to the fuel consumption test, in recent years, in addition to the measurements under high temperature conditions which have been conventionally performed, reducing the viscous resistance at a low temperature is effective for improving the fuel efficiency.

To reduce the viscous resistance of engine oils, it is effective to reduce their viscosity. Reducing the viscosity is effective for reducing both the friction loss and agitation loss, particularly at a low temperature.

In order to reduce the viscosity at a low temperature, the use of a polymer as disclosed in Patent Document 1 is known. The polymer disclosed in Patent Document 1 dissolves in a base oil at a high temperature to favorably increase its viscosity; on the other hand, the solubility of the polymer in the base oil decreases at a low temperature, thereby reducing the effect on the effective volume (flow rate) and the viscosity of the oil.

The viscosity modifier disclosed in Patent Document 1 enables to reduce the low temperature viscosity of a lubricating oil composition containing the viscosity modifier, and thus contributes, to a certain extent, in improving the fuel efficiency under conditions where the internal temperature of an engine is low (for example, at the time of start-up of the engine). However, with increasing demands for fuel saving, a further decrease in the low temperature viscosity is needed.

To improve the low temperature properties of a lubricating oil composition in a balanced manner, a method is known in which an ethylene/propylene copolymer having a high ethylene content is used as a viscosity modifier (see Patent Document 2, for example). However, although an increase in the ethylene content improves the low temperature properties, it causes the crystallization of ethylene chains of the viscosity modifier at a low temperature, possibly resulting in a reduced storage stability of the lubricating oil composition under low temperature conditions.

In view of the above situation, a viscosity modifier for lubricating oils is needed, which enables to obtain a lubricating oil composition excellent in storage stability under low temperature conditions as well as in viscosity characteristics at a low temperature.

To improve the low temperature storage stability and the low temperature properties of a lubricating oil composition, a method is known in which a blend of ethylene/α-olefin copolymers which are different with each other in the amount of structural units derived from ethylene is used as a viscosity modifier for lubricating oils (see Patent Document 3, for example). Alternatively, a method is known in which an olefin block copolymer including ethylene/α-olefin polymer blocks which are different with each other in the amount of structural units derived from ethylene is used as a viscosity modifier for lubricating oils (see Patent Document 4, for example).

CITATION LIST

Patent Documents

Patent Document 1: WO 2000/060032
Patent Document 2: WO 2000/034420
Patent Document 3: JP 2003-105365 A
Patent Document 4: WO 2008/047878

SUMMARY OF INVENTION

Technical Problem

In a lubricating oil composition including a conventional viscosity modifier for lubricating oils, the balance between the storage stability under low temperature conditions and the low temperature properties has not yet been sufficient.

An object of the present invention is to provide a viscosity modifier for lubricating oils and an additive composition for lubricating oils, for obtaining a lubricating oil composition which is particularly excellent in viscosity characteristics at a low temperature, namely, a lubricating oil composition in which an increase in the low temperature viscosity is prevented while ensuring a viscosity required at a high temperature, and which is also excellent in storage stability under low temperature conditions.

Further, an object of the present invention is to provide a viscosity modifier for lubricating oils and an additive composition for lubricating oils, for obtaining a lubricating oil composition excellent in storage stability under low temperature conditions as well as in viscosity characteristics at a low temperature.

Solution to Problem

The present inventors have found out, as a result of intensive studies, that the above described problems can be solved by using a viscosity modifier for lubricating oils which satisfies specific requirements in an additive composition for lubricating oils.

In other words, the present invention relates to:

a lubricating oil composition including a polymer (A) and a base oil (B), wherein the polymer (A) satisfies the following requirement (A-1):

(A-1) the polymer (A) is a polymer containing a structural unit derived from an α-olefin having 20 or less carbon atoms; and wherein the content ratio of the polymer (A) and the base oil (B) is such that the ratio of a resin (A) is within the range of from 0.1 to 50 parts by mass with respect to 100 parts by mass of the total amount of the polymer (A) and the base oil (B).

Advantageous Effects of Invention

The use of the viscosity modifier for lubricating oils according to the present invention enables to provide a lubricating oil composition particularly excellent in viscosity characteristics at a low temperature.

Further, the use of the viscosity modifier for lubricating oils according to the present invention enables to provide a lubricating oil composition excellent in storage stability under low temperature conditions as well as in viscosity characteristics at a low temperature. Alternatively, it is possible to provide an additive composition for lubricating oils, capable of providing the above described lubricating oil composition.

DESCRIPTION OF EMBODIMENTS

The present invention will now be specifically described. Note that, in the following descriptions, the expression "from * to *" used to describe a numerical range refers to a range of "* or more and * or less", unless otherwise defined.

<Lubricating Oil Composition>

A lubricating oil composition (D1) according to the present invention contains a resin (A) and a base oil (B). The respective components will be described in detail below.

<Resin (A)>

The resin (A), which is one of the components constituting the lubricating oil composition, satisfies the following requirements (A-1) to (A-4).

[Requirement (A-1)]

The resin (A) is a polymer containing two or more structural units derived from α-olefins having 20 or less carbon atoms and ethylene.

Examples of the "a-olefins having 20 or less carbon atoms and ethylene" include: linear a-olefins having from 2 to 20 carbon atoms, preferably from 2 to 15 carbon atoms, and more preferably from 2 to 10 carbon atoms, such as ethylene, propylene, 1-butene, 1-pentene, 1-hexene, 1 octene, 1-decene, 1-undecene, 1-dodecene, 1-tetradecene, 1-hexadecene, 1-octadecene and 1-eicosene; and branched α-olefins having from 5 to 20 carbon atoms, and preferably from 5 to 15 carbon atoms, such as 3-methyl-1-butene, 3-methyl-1-pentene, 3-ethyl-1-pentene, 4-methyl-1-pentene, 4,4-dimethyl-1-pentene, 4-methyl-1-hexene, 4,4-dimethyl-1-hexene, 4-ethyl-1-hexene and 3-ethyl-1-hexene. Among these, 4-methyl-1-pentene is preferred. Further, as another α-olefin, ethylene, propylene, 1-butene, 1-pentene, 1-hexene or 1-octene is preferred, ethylene or propylene is more preferred, and propylene is particularly preferred.

The resin (A) according to the present invention preferably contains a structural unit derived from 4-methyl-1-pentene. More preferably, the resin (A) contains the structural unit derived from 4-methyl-1-pentene in an amount within the range of from 30 to 90% by mole with respect to the total structural units constituting the resin (A). Still more preferably, the resin (A) contains the structural unit derived from 4-methyl-1-pentene resin (A) in an amount within the range of from 50 to 90% by mole with respect to the total structural units constituting the resin (A). It is preferred that the resin (A) contain the structural unit derived from 4-methyl-1-pentene, because the glass transition temperature (Tg) in the requirement (A-4) to be described later can be easily controlled within a desired range.

The resin (A) according to the present invention more preferably contains, in addition to the structural unit derived from 4-methyl-1-pentene, a structural unit derived from propylene or ethylene in an amount within the range of from 10 to 70% by mole with respect to the total structural units. Still more preferably, the resin (A) contains the structural unit derived from propylene in an amount within the range of from 10 to 50% by mole with respect to the total structural units.

It is preferred that the resin (A) according to the present invention contain the structural unit derived from 4-methyl-1-pentene and the structural unit derived from propylene or ethylene in amounts within the above described respective ranges, because the melting point (Tm) in the requirement (A-3) to be described later, and the glass transition temperature (Tg) in the requirement (A-4) to be described later, can be easily controlled within respective desired ranges.

[Requirement (A-2)]

The resin (A) according to the present invention has an intrinsic viscosity [η] as measured in decalin at 135° C. within the range of from 0.01 to 5.0 dl/g. The intrinsic viscosity [η] of the resin (A) is preferably within the range of from 0.05 to 4.0 dl/g, and more preferably within the range of from 0.1 to 2.5 dl/g. The intrinsic viscosity [η] is still more preferably within the range of from 1.3 to 2.0 dl/g.

The intrinsic viscosity [η] can be adjusted within the above described range, by controlling, for example, the temperature during the polymerization of the resin (A), and the amount of a molecular weight regulator, such as hydrogen, to be used in the polymerization. A larger value of the intrinsic viscosity [η] results in a higher viscosity of the resin (A) and of the resulting viscosity modifier for lubricating oils. In the production of a lubricating oil composition, in general, the amount to be added of the viscosity modifier for lubricating oils is adjusted as appropriate, so that the lubricating oil composition has required physical properties, for example, a kinematic viscosity at 100° C.

adjusted to a specific value. It is preferred that the intrinsic viscosity [η] of the resin (A) be within the above described range, because the amount to be added of the resulting viscosity modifier for lubricating oils can be adjusted to an appropriate ratio with respect to the amount of the base oil.

[Requirement (A-3)]

The resin (A) according to the present invention has a melting point (Tm), as measured by differential scanning calorimetry (DSC), of less than 110° C., or has no detected melting point (Tm). More preferably, the melting point (Tm) is not detected. In other words, the resin (A) is an amorphous or low-crystalline resin, and thus can be said to be excellent in storage stability at a low temperature.

[Requirement (A-4)]

The resin (A) according to the present invention has a glass transition temperature (Tg), as measured by differential scanning calorimetry (DSC), within the range of from −10 to 50° C. More preferably, the glass transition temperature of the resin (A) is within the range of from 1.0 to 50° C. When the glass transition temperature (Tg) is within the above described range, the resin (A) vitrifies at a low temperature range of equal to or less than the glass transition temperature (Tg), to result in an enhanced cohesion between polymer molecules. As a result, it can be expected that the volume occupied by the polymer molecules in the lubricating oil composition is reduced.

The present inventors considers that controlling the glass transition temperature (Tg) of the resin (A) to the above described range, which is an intermediate range between the low temperature and high temperature ranges, enabled to enhance the cohesion between the molecules under low temperature conditions, regardless of the fact that the resin (A) has no crystallinity, which in turn enabled to decrease the low temperature viscosity of the resulting lubricating oil composition. In other words, by controlling the glass transition temperature of the resin (A) to be higher than that of a conventionally used amorphous polymer, it is considered that an excellent flowability at a low temperature is ensured, while maintaining an excellent storage stability under low temperature conditions of the lubricating oil composition, which is obtained as a result of the resin (A) being an amorphous or low-crystalline resin.

The resin (A) according to the present invention preferably satisfies, in addition to the above described requirements, one or more of the following requirements (A-5) to (A-7).

[Requirement (A-5)]

The resin (A) according to the present invention preferably has a weight average molecular weight (Mw) in terms of polystyrene, as measured by gel permeation chromatography (GPC), within the range of from 10,000 to 500,000, more preferably within the range of from 50,000 to 450,000, and still more preferably within the range of from 200,000 to 400,000. It is preferred that the weight average molecular weight of the resin (A) be within the above described range, because the amount to be added of the resulting viscosity modifier for lubricating oils can be adjusted to an appropriate ratio with respect to the amount of the base oil.

[Requirement (A-6)]

The resin (A) according to the present invention preferably has a ratio (molecular weight distribution: Mw/Mn) of the weight average molecular weight (Mw) to the number average molecular weight (Mn), as measured by gel permeation chromatography (GPC), of 1.0 or more, more preferably 1.2 or more, and still more preferably 1.5 or more; and at the same time, preferably 3.5 or less, more preferably 3.0 or less, and still more preferably 2.8 or less. It is preferred that the ratio Mw/Mn be 3.5 or less, because it allows for preventing the deterioration of shear stability caused by high molecular weight components.

[Requirement (A-7)]

The resin (A) according to the present invention preferably has a density (as measured in accordance with ASTM D 1505) of 830 kg/m$^3$ or more; and at the same time, preferably 870 kg/m$^3$ or less, more preferably 865 kg/m$^3$ or less, and still more preferably 855 kg/m$^3$ or less. The density of the resin (A) according to the present invention is adjusted as appropriate, depending on the ratio of the structural unit described in the requirement (A-1). It is preferred that the density of the resin (A) be within the above described range, because it allows for maintaining the storage stability of the lubricating oil composition under low temperature conditions.

<Method of Producing Resin (A)>

The method of producing the resin (A) according to the present invention is not particularly limited, as long as the method allows for obtaining the resin (A) satisfying the above specified requirements. In cases where the resin (A) is a 4-methyl-1-pentene/α-olefin copolymer (the "α-olefin" as used herein refers to any of ethylene and α-olefins having 20 or less carbon atoms), the resin (A) can be obtained by polymerizing 4-methyl-1-pentene and the α-olefin(s) in the presence of an appropriate polymerization catalyst.

As a polymerization catalyst suitable for obtaining the resin (A) according to the present invention, it is possible to use a conventionally known catalyst, such as, for example, a magnesium-supported titanium catalyst, or a metallocene catalyst described in WO 01/53369, WO 01/27124, JP H03-193796 A, JP H02-41303 A or WO 14/050817.

<Base Oil (B)>

The base oil (B) according to the present invention satisfies the following requirement (B-1).

[Requirement (B-1)]

The base oil (B) has a kinematic viscosity at 100° C. of within the range of from 1 to 50 mm$^2$/s.

Examples of the base oil (B) according to the present invention include mineral oils; and synthetic oils such as poly-α-olefins, diesters and polyalkylene glycols.

A mineral oil or a blend of a mineral oil and a synthetic oil may be used as the base oil (B) according to the present invention. Examples of diesters include polyol esters, dioctyl phthalate and dioctyl sebacate.

Mineral oils are usually subjected to a purification process such as dewaxing before use, and are classified into several grades depending on the method of purification used. In general, a mineral oil having a wax content of from 0.5 to 10% is used. For example, it is also possible to use a highly purified oil produced by hydrocracking refining, composed mainly of isoparaffin, and having a low pour point and a high viscosity index. A mineral oil having a kinematic viscosity at 40° C. of from 10 to 200 mm$^2$/s is generally used.

As described above, mineral oils are usually subjected to a purification process such as dewaxing before use, and are classified into several grades depending on the method of purification used, which grades are defined by API (American Petroleum Institute) classification. The properties of lubricating oil bases which are classified into respective groups are shown in Table 1.

TABLE 1

| Group | Type | Viscosity index *1 | Saturated hydrocarbon content *2 (% by volume) | Sulfur content *3 (% by weight) |
|---|---|---|---|---|
| I | Mineral oil | 80 to 120 | <90 | >0.03 |
| II | Mineral oil | 80 to 120 | ≥90 | ≤0.03 |
| III | Mineral oil | ≥120 | ≥90 | ≤0.03 |
| IV | Poly-α-olefin | | | |
| V | Lubricating oil base other than the above | | | |

*1: Measured in accordance with ASTM D445 (JIS K2283)
*2: Measured in accordance with ASTM D3238
*3: Measured in accordance with ASTM D4294 (JIS K2541)

The "Poly-α-olefin" in Table 1 represents a group of hydrocarbon polymers obtained by polymerizing at least an α-olefin having 10 or more carbon atoms, as one of the raw material monomers, and examples thereof include polydecenes obtained by polymerizing 1-decene.

The base oil (B) is preferably a mineral oil belonging to the group (ii) or the group (iii), or a poly-α-olefin belonging to the group (iv). Mineral oils in the group (ii) and the group (iii) tend to have a lower wax concentration as compared to those in the group (i). Among the mineral oils belonging to the group (ii) or the group (iii), a mineral oil having a kinematic viscosity at 100° C. of from 1 to 50 $mm^2/s$ is preferred.

<Content Ratio of Resin (A) and Base Oil (B)>

In the lubricating oil composition according to the present invention, the content ratio of the resin (A) and the base oil (B) is such that the ratio of the resin (A) is within the range of from 0.1 to 50 parts by mass with respect to 100 parts by mass of the total amount of the resin (A) and the base oil (B).

In cases where the lubricating oil composition according to the present invention is used, for example, in an engine application, the lubricating oil composition preferably contains from 0.1 to 5 parts by mass of the resin (A) and from 95 to 99.9 parts by mass of the base oil (B) (with the proviso that the total amount of the resin (A) and the base oil (B) is taken as 100 parts by mass). The lubricating oil composition preferably contains the resin (A) at a ratio of from 0.2 to 4 parts by mass, more preferably from 0.4 to 3 parts by mass, and still more preferably from 0.6 to 2 parts by mass; and preferably contains the base oil (B) at a ratio of from 96 to 99.8 parts by mass, more preferably from 97 to 99.6 parts by mass, and still more preferably from 98 to 99.4 parts by mass. The resin (A) may be used alone, or a plurality of the resins (A) may be used in combination.

In cases where the lubricating oil composition according to the present invention is used as an additive composition for lubricating oils (a so-called concentrate), on the other hand, the lubricating oil composition preferably contains the resin (A) at a ratio of from 1 to 50 parts by mass, and the base oil (B) at a ratio of from 50 to 99 parts by mass (with the proviso that the total amount of the resin (A) and the base oil (B) is taken as 100 parts by mass). The lubricating oil composition more preferably contains from 2 to 40 parts by mass of the resin (A) and from 60 to 98 parts by mass of the base oil (B). Still more preferably, the lubricating oil composition contains from 3 to 30 parts by mass of the resin (A) and from 70 to 97 parts by mass of the base oil (B).

In cases where the lubricating oil composition according to the present invention is used as an additive composition for lubricating oils (a so-called concentrate), in general, the lubricating oil composition does not contain a pour point depressant (C) and any other components (additives) to be described later, or alternatively, the composition contains an antioxidant to be described later, as necessary, in an amount within the range of from 0.01 to 1% by mass, and preferably from 0.05 to 0.5% by mass. By incorporating the base oil (B), the pour point depressant (C) and any other components (additives) to be described later, the additive composition for lubricating oils can be used as a lubricating oil composition for use in various types of applications.

<Pour Point Depressant (C)>

The lubricating oil composition according to the present invention may further contain a pour point depressant (C). The content of the pour point depressant (C) is usually from 0.05 to 5% by mass, preferably from 0.05 to 3% by mass, more preferably from 0.05 to 2% by mass, and still more preferably from 0.05 to 1% by mass, in 100% by mass of the lubricating oil composition, but not particularly limited thereto as long as the effect of the present invention can be obtained.

Examples of the pour point depressant (C) which may be contained in the lubricating oil composition according to the present invention include alkylated naphthalenes, (co)polymers of alkyl methacrylates, (co)polymers of alkyl acrylates, copolymers of alkyl fumarates and vinyl acetate, α-olefin polymers, and copolymers of α-olefins and styrene. In particular, a (co)polymer of an alkyl methacrylate or a (co)polymer of an alkyl acrylate may be used.

<Other Components (Additives)>

Further, the lubricating oil composition according to the present invention may contain any other components (additives) other than the resin (A) and the base oil (B). As the other components, the lubricating oil composition may optionally contain any one or more of the materials to be described later, for example.

In cases where the lubricating oil composition according to the present invention contains an additive(s), the content thereof is not particularly limited. However, the content of the additive (s) is usually more than 0% by mass, preferably 1% by mass or more, more preferably 3% by mass or more, and still more preferably 5% by mass or more, with respect to 100% by mass of the total amount of the base oil (B) and the additive (s). Further, the content of the additive(s) is usually 40% by mass or less, preferably 30% by mass or less, more preferably 20% by mass or less, and still more preferably 15% by mass or less.

One of such additives is a detergent. Many of conventional detergents used in the field of engine lubrication provide basicity or TBN to lubricating oils, by the presence of a basic metal compound (a metal hydroxide, a metal oxide or a metal carbonate, which is typically based on a metal such as calcium, magnesium, or sodium) contained therein. Such metallic overbased detergents (also referred to as overbased salts or superbased salts) are generally single phase, homogeneous Newtonian systems characterized by a metal content in excess of that which would be present for neutralization according to the stoichiometry of the metal and a particular acidic organic compound reacted with the metal. The overbased materials are typically prepared by allowing an acidic material (typically, an inorganic acid or lower carboxylic acid, such as carbon dioxide) to react with a mixture of an acidic organic compound (also referred to as a substrate) and a stoichiometric excess of a metal salt, typically in an organic solvent (such as a mineral oil, naphtha, toluene, or xylene) which is inert to the acidic organic substrate. Optionally, a small amount of a promoter such as a phenol or alcohol is contained. The acidic organic substrate will normally have a sufficient number of carbon atoms to provide a certain degree of solubility in oil.

Such conventional overbased materials and methods for preparing these materials are well known to those skilled in the art. Examples of patents describing techniques for producing basic metal salts of sulfonic acids, carboxylic acids, phenols, phosphoric acids, and mixtures of two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate detergents are described in U.S. Pat. No. 6,200,936 and WO 01/56968. Saligenin detergents are described in U.S. Pat. No. 6,310,009.

A typical amount of detergent to be contained in the lubricating oil composition is usually from 1 to 10% by mass, preferably from 1.5 to 9.0% by mass, and more preferably from 2.0 to 8.0% by mass, but not particularly limited thereto as long as the effect of the present invention can be obtained. The values of the above described amount are all expressed on an oil-free basis (namely, a state where a diluent oil conventionally contained in such a detergent is absent).

Another additive is a dispersant. Dispersants are well known in the field of lubricating oils, and examples thereof include primarily those known as ashless dispersants and polymeric dispersants. Ashless dispersants are characterized by a polar group attached to a hydrocarbon chain having a relatively high molecular weight. Examples of typical ashless dispersants include nitrogen-containing dispersants such as N-substituted long-chain alkenyl succinimides, which are also known as succinimide dispersants. Succinimide dispersants are more fully described in U.S. Pat. Nos. 4,234,435 and 3,172,892. Another class of ashless dispersants is high molecular weight esters prepared by the reaction of a polyvalent aliphatic alcohol such as glycerol, pentaerythritol or sorbitol with a hydrocarbyl acylating agent. U.S. Pat. No. 3,381,022 describes such materials in detail. Still another class of ashless dispersants is Mannich bases. These are materials formed by the condensation of a higher molecular weight alkyl-substituted phenol, an alkylene polyamine, and an aldehyde such as formaldehyde, and are described in more detail in U.S. Pat. No. 3,634,515. Examples of other dispersants include polyvalent additives having dispersibility, which are generally hydrocarbon-based polymers that contain polar functionality to impart dispersive properties to the polymer.

Dispersants may be post-treated by allowing them to react with any of a variety of substances. Examples of these substances include urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatments can be found in U.S. Pat. No. 4,654,403. The amount of dispersant to be contained in the composition according to the present invention is not particularly limited as long as the effect of the present invention can be obtained, and the amount may typically be from 1 to 10% by mass, preferably from 1.5 to 9.0% by mass, and more preferably from 2.0 to 8.0% by mass (all values are expressed on an oil-free basis).

Still another component is an antioxidant. Antioxidants encompass phenolic antioxidants, which may include a butyl-substituted phenol containing 2 or 3 t-butyl groups. The para position may be occupied by a hydrocarbyl group or a group bridging two aromatic rings. The antioxidants of the latter type are described in greater detail in U.S. Pat. No. 6,559,105. Antioxidants also include aromatic amines such as nonylated diphenylamines. Examples of other antioxidants include sulfurized olefins, titanium compounds, and molybdenum compounds. For example, U.S. Pat. No. 4,285,822 discloses lubricating oil compositions containing a molybdenum and sulfur containing composition. Typical amounts of antioxidants will, of course, depend on the specific type and the individual effectiveness of the antioxidants used. Illustratively, the total amount thereof may be from 0.01 to 5% by mass, preferably from 0.15 to 4.5% by mass, and more preferably from 0.2 to 4% by mass. Further, one or more antioxidants may be contained, and certain combinations of these can be synergistic in their combined overall effect.

The lubricating oil composition may also contain a thickener (sometimes referred to as a viscosity index improver or a viscosity modifier). The thickener to be used is usually a polymer, and examples thereof include polyisobutenes, polymethacrylic acid esters, diene polymers, polyalkyl styrenes, esterified styrene-maleic anhydride copolymers, alkenyl arene-conjugated diene copolymers, polyolefins, hydrogenated SBR (styrene butadiene rubbers) and SEBS (styrene ethylenebutylene styrene block copolymers). Multifunctional thickeners which also have dispersibility and/or antioxidative properties are well known, and any of these may optionally be used.

Another additive is an anti-wear agent. Examples anti-wear agents include phosphorus-containing anti-wear/extreme pressure agents, such as metal thiophosphates, phosphoric acid esters and salts thereof, phosphorus-containing carboxylic acids, esters, ethers and amides; and phosphites. In a specific embodiment, a phosphorus anti-wear agent may be contained in an amount to give usually from 0.01 to 0.2% by mass, preferably from 0.015 to 0.15% by mass, more preferably from 0.02 to 0.1% by mass, and still more preferably from 0.025 to 0.08% by mass of phosphorus. However, the amount is not particularly limited as long as the effect of the present invention can be obtained.

The anti-wear agent is a zinc dialkyldithiophosphate (ZDP), in many cases. A typical ZDP may contain 11% by mass of P (calculated on an oil-free basis), and a suitable amount thereof may be, for example, from 0.09 to 0.82% by mass. Examples of anti-wear agents which do not contain phosphorus include boric acid esters (including borated epoxides), dithiocarbamate compounds, molybdenum-containing compounds, and sulfurized olefins.

Examples of other additives which may be optionally contained in the lubricating oil composition, in addition to the above described extreme pressure agents and anti-wear agents, include friction modifiers, color stabilizers, rust inhibitors, metal inactivating agents and antifoaming agents. Each of these may be used in a conventionally known amount.

<Method of Producing Lubricating Oil Composition>

The lubricating oil composition according to the present invention can be produced in accordance with a conventionally known method, by mixing the resin (A) and the base oil (B), optionally along with any other desired components. Since the resin (A) is easy to handle, it may optionally be supplied as a concentrate in the base oil (B).

Viscosity Modifier for Lubricating Oils

The viscosity modifier for lubricating oils according to the present invention contains the resin (A) which contains a polymer satisfying the following requirements (A-1) to (A-4).

(A-1) The polymer is a polymer containing two or more structural units derived from a-olefins having 20 or less carbon atoms and ethylene.

(A-2) The polymer has an intrinsic viscosity [11] as measured in decalin at 135° C. of within the range of from 0.01 to 5.0 dl/g.

(A-3) The polymer has a melting point (Tm) as measured by differential scanning calorimetry (DSC) of less than 110° C., or has no detected melting point (Tm).

(A-4) The polymer has a glass transition temperature (Tg) as measured by differential scanning calorimetry (DSC) of within the range of from −10 to 50° C.

In the viscosity modifier for lubricating oils according to the present invention, the polymer contained in the resin (A), in the requirement (A-1), contains a structural unit derived from 4-methyl-1-pentene in an amount within the range of from 30 to 90% by mole with respect to the total structural units.

In the viscosity modifier for lubricating oils according to the present invention, the polymer in the requirement (A-1) contains a structural unit derived from propylene or ethylene in an amount within the range of from 10 to 70% by mole with respect to the total structural units.

In the viscosity modifier for lubricating oils according to the present invention, the polymer in the requirement (A-1) contains the structural unit derived from propylene in an amount within the range of from 10 to 70% by mole with respect to the total structural units.

In the viscosity modifier for lubricating oils according to the present invention, the intrinsic viscosity [η] as measured in decalin at 135° C., in the requirement (A-2), is within the range of from 0.1 to 2.5 dl/g.

In the viscosity modifier for lubricating oils according to the present invention, the glass transition temperature (Tg) as measured by differential scanning calorimetry (DSC), in the requirement (A-4), is within the range of from 1 to 50° C.

Further, the viscosity modifier for lubricating oils according to the present invention contains a 4-methyl-1-pentene polymer (A) (hereinafter, sometimes abbreviated as "polymer (A)".

The viscosity modifier for lubricating oils according to the present invention may contain, for example, any of resins other than the polymer (A) and additives, as long as the effect of the present invention is not impaired. The ratio of the polymer (A) with respect to the total amount of the viscosity modifier for lubricating oils is preferably 30% by mass or more, more preferably 50% by mass or more, still more preferably 80% by mass or more, and particularly preferably 90% by mass or more. Examples of components other than the 4-methyl-1-pentene polymer (A) which can be contained in the viscosity modifier for lubricating oils include known viscosity modifiers for lubricating oils, resins used therein, and various types of additives such as antioxidants as will be exemplified in the section of the lubricating oil composition to be described later.

<Polymer (A)>

The polymer (A) according to the present invention contains a structural unit derived from 4-methyl-1-pentene in an amount within the range of from 50 to 100% by mole, preferably from 65 to 99% by mole, more preferably from 80 to 98% by mole, and still more preferably from 90 to 98% by mole; and contains a structural unit derived from at least one selected from ethylene and α-olefins having from 3 to 20 carbon atoms other than 4-methyl-1-pentene (hereinafter, also simply referred to as "ethylene and α-olefins having from 3 to 20 carbon atoms) in an amount within the range of from 0 to 50% by mole, preferably from 1 to 35% by mole, more preferably from 2 to 20% by mole, and still more preferably from 2 to 10% by mole.

When the ratio of the structural unit derived from 4-methyl-1-pentene is equal to or higher than the above described lower limit value, the resulting viscosity modifier for lubricating oils will have excellent viscosity characteristics at a low temperature. The content of the structural unit derived from 4-methyl-1-pentene in the polymer (A) can be adjusted within the above described range, by controlling the ratio of α-olefin monomers to be used as raw materials.

One kind of ethylene and α-olefins having from 3 to 20 carbon atoms can be used, or a plurality of these can be used in combination. These α-olefins are preferably α-olefins having from 4 to 20 carbon atoms, and more preferably α-olefins having from 6 to 18 carbon atom. It is preferred that the α-olefins have carbon atoms within the above described range, because it allows for improving the solubility in a base oil, and the appearance upon melting.

Specific examples of ethylene and α-olefins having from 3 to 20 carbon atoms include ethylene, propylene, 1-butene, 2-methyl-1-propene, 2-methyl-1-butene, 3-methyl-1-butene, 1-hexene, 2-ethyl-1-butene, 2,3-dimethyl-1-butene, 2-methyl-1-pentene, 3-methyl-1-pentene, 3,3-dimethyl-1-butene, 1-heptene, methyl-1-hexene, dimethyl-1-pentene, ethyl-1-pentene, trimethyl-1-butene, methylethyl-1-butene, 1-octene, methyl-1-pentene, ethyl-1-hexene, dimethyl-1-hexene, propyl-1-heptene, methylethyl-1-heptene, trimethyl-1-pentene, propyl-1-pentene, diethyl-1-butene, 1-nonene, 1-decene, 1-undecene, 1-dodecene, 1-tetradecene, 1-hexadecene, 1-octadecene and 1-eicosene.

More preferred are α-olefins having from 6 to 18 carbon atoms, and specific examples thereof include: linear olefins such as 1-hexene, 1-octene, 1-decene, 1-dodecene, 1-tetradecene, 1-hexadecene and 1-octadecene; and branched olefins such as 3-methyl-1-pentene and 3-methyl-1-butene. Among these, ethylene, propylene, 1-butene, 1-pentene, 1-hexene and 1-octene are preferred. Further, two or more kinds of these olefins can be used in combination.

The lubricating oil composition containing the viscosity modifier for lubricating oils which contains the polymer (A) according to the present invention has better viscosity characteristics at a low temperature, as compared to that of a conventional lubricating oil composition.

The structural units in the polymer (A) can be measured by $^{13}$C-NMR, in accordance with the method described in "Polymer Analysis Handbook" (edited by Research Committee of Polymer Analysis, The Japan Society for Analytical Chemistry, published by Kinokuniya Co., Ltd., issued on Jan. 12, 1995).

The polymer (A) according to the present invention satisfies the following requirements (I) to (III), in addition to containing the above described structural units in the above described ranges.

[Requirement (I)]

The polymer (A) according to the present invention has an isotactic dyad fraction, as measured by $^{13}$C-NMR, within the range of from 40 to 95%. Preferably, the isotactic dyad fraction of the polymer (A) is within the range of from 50 to 90%. It is preferred that the isotactic dyad fraction be within the above described range, because it allows for improving the storage stability under low temperature conditions, and the solubility in a base oil.

The isotactic dyad fraction (also referred to as "dyad tacticity (m fraction)") of the polymer (A) as used herein can be obtained according to the following method.

(Dyad Tacticity (m Fraction))

The dyad tacticity (m fraction) of the 4-methyl-1-pentene polymer is defined as the ratio of isobutyl-branches extending in the same direction, when a sequence of two arbitrary 4-methyl-1-pentene units linked head-to-tail, in the polymer chain, is represented as a planar zigzag structure. The dyad tacticity was determined from the $^{13}$C-NMR spectrum of the polymer, in accordance with the following Equation (1).

$$\text{Dyad tacticity (\%)}=[m/(m+r)]\times 100 \quad (1)$$

In the equation (1), m and r indicate absorption intensities assigned to the main chain methylene groups in the sequences of head-to-tail linked 4-methyl-1-pentene units, represented by the following formulae:

[Chem. 1]

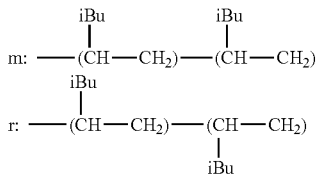

The $^{13}$C-NMR spectrum of the polymer was measured as follows. In an NMR sample tube (diameter: 5 mm), a sample was completely dissolved in a solvent obtained by adding about 0.05 ml of deuterated benzene as a lock solvent to about 0.5 ml of hexachlorobutadiene, o-dichlorobenzene or 1,2,4-trichlorobenzene. The resulting solution was then subjected to the measurement by the proton complete decoupling method at 120° C., using a nuclear magnetic resonance apparatus with a $^{1}$H resonance frequency of 500 MHz. The measurement is carried out under conditions of a flip angle of 45° and a pulse interval of 5 sec or more. The chemical shift of benzene was set to 127.7 ppm, and the chemical shifts of other carbon peaks are determined using this value as a standard.

The peak region in the range of from 41.5 to 43.3 ppm was divided at the minimum point of the peak profile into a first region on the higher magnetic field side, and a second region on the lower magnetic field side. In the first region, the main chain methylene groups in the sequence of two 4-methyl-1-pentene units represented by (m) resonate; but a peak of the methylene group attached to a comonomer also overlaps therewith. Therefore, a integral value was defined as "m" which integral value was obtained by subtracting a doubled value of the peak area derived from the comonomer within the range of from 34.5 to 35.5 ppm from the peak area in the first region.

In the second region, the main chain methylene groups in the sequence of two 4-methyl-1-pentene units represented by (r) resonate, and the integral value thereof was defined as "r".

[Requirement (II)]

The polymer (A) according to the present invention has a weight average molecular weight (Mw), as measured by gel permeation chromatography (GPC), within the range of from 50,000 to 500,000. The weight average molecular weight of the polymer (A) is preferably within the range of from 60,000 to 450,000, and more preferably from 70,000 to 400,000. As described above, the term "weight average molecular weight" in the present invention refers to a weight average molecular weight in terms of polystyrene, as measured by GPC. The method of measuring the weight average molecular weight by GPC will be described in the section of Examples. The weight average molecular weight (Mw) can be adjusted within the above described range, by controlling, for example, the temperature during the polymerization of the 4-methyl-1-pentene polymer (A), and the amount of a molecular weight regulator, such as hydrogen, to be used in the polymerization.

[Requirement (III)]

The polymer (A) according to the present invention has a ratio (molecular weight distribution: Mw/Mn) of the weight average molecular weight (Mw) to the number average molecular weight (Mn), as measured by GPC, within the range of from 2.0 to 20.0. The ratio Mw/Mn is preferably within the range of from 3.0 to 15.0, and more preferably from 5.0 to 12.0. When the molecular weight distribution is within the above described range, an excellent low temperature fluidity and reproducibility of shear stability index can be obtained. The ratio Mw/Mn can be adjusted within the above described range, by controlling, for example, the temperature during the polymerization, and the amount of a molecular weight regulator, such as hydrogen, to be used in the polymerization, in the production process.

The polymer (A) according to the present invention preferably satisfies the following requirements (IV) and (V), in addition to the above described requirements (I) to (III).

[Requirement (IV)]

With regard to a melting point (Tm) as measured by differential scanning calorimetry (DSC), the polymer (A) has no observed melting point (Tm) or has the melting point (Tm) of within the range of less than 220° C. Preferably, the melting point (Tm) is not observed, or is within the range of 0° C. or higher and less than 220° C. More preferably, the melting point (Tm) is not observed, or is within the range of 0° C. or higher and less than 200° C. Still more preferably, the melting point (Tm) is not observed, or is within the range of 0° C. or higher and less than 180° C. When the melting point (Tm) is equal to or lower than the above described upper limit value, an excellent storage stability under low temperature conditions can be obtained. In cases where two or more melting peaks are observed in the measurement by differential scanning calorimetry (DSC), the temperature of the highest peak is defined as the Tm.

Although the melting point (Tm) of the polymer (A) according to the present invention can be adjusted by various types of factors, it is primarily adjusted by controlling the stereoregularity of the 4-methyl-1-pentene polymer (A) and the composition of the structural units constituting the polymer. Specifically, an increase in the content ratio of the structural unit derived from 4-methyl-1-pentene tends to result in a higher melting point (Tm), and a decrease in the content ratio thereof tends to result in a lower melting point (Tm). In other words, the melting point (Tm) can be adjusted within the above described range, by controlling the concentration of 4-methyl-1-pentene to be present in the polymerization reaction system, the polymerization temperature and the polymerization time, and by selecting the type of the catalyst to be used in the reaction. The method for measuring the melting point (Tm) of the polymer (A) by differential scanning calorimetry (DSC) will be described in detail in the section of Examples.

[Requirement (V)]

The polymer (A) has a heat of fusion (ΔH) as measured by differential scanning calorimetry (DSC) of within the range of from 0 to 20 J/g. The heat of fusion (ΔH) is preferably within the range of from 0 to 18 J/g, and more preferably from 0 to 16 J/g. When the heat of fusion (ΔH) is equal to or lower than the above described upper limit value, an excellent storage stability under low temperature conditions can be obtained.

The heat of fusion (ΔH) of the polymer (A) according to the present invention is adjusted by controlling the stereoregularity of the polymer and the composition of the structural units constituting the polymer. Specifically, an increase in the content ratio of the structural unit derived from 4-methyl-1-pentene tends to result in a higher heat of fusion (ΔH), and a decrease in the content ratio thereof tends to result in a lower heat of fusion (ΔH). In other words, the heat of fusion (ΔH) can be adjusted within the above described range, by controlling the concentration of 4-methyl-1-pentene to be present in the polymerization reaction system, the polymerization temperature and the polymerization time, and by selecting the type of the catalyst to be used in the reaction. The method for measuring the heat of fusion (ΔH) of the 4-methyl-1-pentene polymer (A) by differential scanning calorimetry (DSC) will be described in detail in the section of Examples.

<Method of Producing Viscosity Modifier for Lubricating Oils>

The 4-methyl-1-pentene polymer (A) contained in the viscosity modifier for lubricating oils according to the present invention can be produced by a method which includes the step of producing the 4-methyl-1-pentene polymer (A) by the following production method.

<Method of Producing 4-Methyl-1-Pentene Polymer (A)>

The method of producing the 4-methyl-1-pentene polymer (A) according to the present invention will now be described in detail.

[Polymerization Catalyst]

The polymerization catalyst to be used in the present invention may be, for example, a so-called Ziegler catalyst or metallocene catalyst, etc. In particular, preferably used is a catalyst formed from: (a) a highly stereoregular titanium catalyst component containing, as an essential components, magnesium, titanium, a halogen and an electron donor; (b) an organoaluminum compound catalyst component; and (c) an electron donor component.

The highly stereoregular titanium catalyst contains, as essential components, magnesium, titanium, a halogen, and an electron donor. In such a titanium catalyst component (a), the ratio (atomic ratio) of magnesium atoms to titanium atoms is preferably within the range of from 2 to 100, and more preferably from 4 to 70; the ratio (atomic ratio) of halogen atoms to titanium atoms is preferably within the range of from 4 to 100, and more preferably from 6 to 40; and the ratio (atomic ratio) of the electron donor to titanium atoms is preferably within the range of from 0.2 to 10, and more preferably from 0.4 to 6.

The highly stereoregular titanium catalyst component (a) preferably has a specific surface area of 3 $m^2/g$ or more, more preferably 40 $m^2/g$ or more, and particularly preferably from 100 $m^2/g$ to 8,000 $m^2/g$.

When such a titanium catalyst component (a) is simply washed with hexane at room temperature, a titanium compound is not substantially released, in general.

The X-RAY spectrum of the titanium catalyst component (a) desirably shows that the component (a) has amorphous characteristics regardless of the type of a starting magnesium compound used in the preparation of the catalyst, or alternatively, that the component (a) is in an extremely amorphous state as compared a common, commercially available magnesium halide.

The titanium catalyst component (a) may contain, for example, any other elements, metals and/or functional groups, in addition to the essential components, as long as the performance of the catalyst is not greatly impaired. Further, the titanium catalyst component (a) may be diluted with an organic or inorganic diluent.

In cases where the titanium catalyst component (a) contains another component(s), such as any other elements, metals and/or diluents, as described above, it is preferred that the titanium catalyst component (a) have a specific surface area value within the above mentioned range, and exhibit amorphous characteristics when such another component(s) is/are removed.

It is desired that the titanium catalyst component (a) usually have an average particle size of from 1 to 200 μm, and preferably from 5 to 100 μm, and that the geometric standard deviation σg of the particle size distribution of the titanium catalyst component (a) be usually less than 2.1, and preferably 1.95 or less. Further, the particles of the titanium catalyst component (a) preferably have a regular shape, for example, are in the form of true spheres, ellipsoids and granules.

The titanium catalyst component (a) can be produced by bringing a magnesium compound (or magnesium metal), a titanium compound and an electron donor or an electron donor-forming compound (a compound capable of forming an electron donor) into contact with each other, with or without another reaction agent.

In other words, the titanium catalyst component (a) can be produced in accordance with a conventionally known method of preparing a highly active titanium catalyst component which contains magnesium, titanium, a halogen and an electron donor as essential components.

Examples of the method of preparing such a highly active titanium catalyst component (a) include those disclosed in JP S50-108385 A, JP S50-126590 A, JP S51-20297 A, JP S51-28189 A, JP S51-64586 A, JP S51-92885 A, JP S51-136625 A, JP S52-87489 A, JP S52-100596 A, JP S52-147688 A, JP S52-104593 A, JP S53-2580 A, JP S53-40093 A, JP S53-43094 A, JP S55-135102 A, JP S55-135103 A, JP S56-811 A, JP S56-11908 A, JP S56-18606 A, JP S58-83006 A, JP S58-138705 A, JP S58-138706 A, JP S58-138707 A, JP S58-138708 A, JP S58-138709 A, JP S58-138710 A and JP S58-138715 A.

In the preparation of the catalyst, a method is preferably used in which a titanium halide in the form of liquid is used, or a method in which a halogenated hydrocarbon is used after or during the use of a titanium compound.

Examples of the electron donor to be used in the preparation of the titanium catalyst component (a) include diesters, diester-forming compounds, alcohols, phenols, aldehydes, ketones, ethers, carboxylic acids, carboxylic anhydrides, carbonic acid esters, monoesters and amines.

Among diesters, a dicarboxylic acid ester in which two carboxyl groups are bound to one carbon atom, or a dicarboxylic acid ester in which a carboxyl group is bound to each of two adjacent carbon atoms is preferably used.

The magnesium compound to be used in the preparation of the highly stereoregular stereoregularity titanium catalyst component (a) is a magnesium compound having a reducing ability, or a magnesium compound having no reducing ability. The magnesium compound having a reducing ability may be, for example, a magnesium compound containing a magnesium-carbon bond or a magnesium-hydrogen bond. Among these, preferably used is a magnesium compound having no reducing ability, and particularly preferred is a halogen-containing magnesium compound. Above all, magnesium chloride, an alkoxy magnesium chloride, or an aryloxy magnesium chloride is preferably used.

Examples of the titanium compound to be used in the preparation of the titanium catalyst component (a) include quadrivalent titanium compounds represented by the formula: $Ti(OR)_gX_{4-g}$ (wherein R represents a hydrocarbon group; X represents a halogen atom; and g satisfies $0 \leq g \leq 4$). Among these, preferably used is a halogen-containing titanium compound, particularly preferably a titanium tetrahalide, and still more preferably titanium tetrachloride.

As the organoaluminum compound catalyst component (b), it is possible to use a compound containing at least one A1-carbon bond within the molecule. Examples thereof include: organoaluminum compounds represented by the formula (i): $R^1_mAl(OR^2)_nH_pX_q$ (wherein each of $R^1$ and $R^2$ represents a hydrocarbon group usually having from 1 to 15 carbon atoms, and preferably from 1 to 4 atoms, and $R^1$ and $R^2$ may be the same as, or different from, each other; X represents a halogen atom; and m, n, p and q are numbers satisfying: $0<m\leq 3$, $0\leq n<3$, $0\leq p<3$, $0\leq q<3$, and $m+n+p+q=3$); and alkylated complexes of a metal of Group I and aluminum, represented by the formula (ii): $M^1AlR^1_4$ (wherein $M^1$ is Li, Na or K; $R^1$ is the same as defined in the formula (i)). Among these, in particular, it is preferred to use a trialkylaluminum such as triethylaluminum or tributylaluminum, or an alkylaluminum in which two or more kinds of the above described aluminum compounds are bound.

Examples of the electron donor (c) include amines, amides, ethers, ketones, nitriles, phosphines, stibines, arsines, phosphoryl amides, esters, thioethers, thioesters, acid anhydrides, acid halides, aldehydes, alcoholates, alkoxy (aryloxy) silanes, and amides and salts of organic acids and of metals belonging to Group I to Group IV of the periodic table. The above described salts can be obtained, for example, by allowing an organic acid to react with an organic metal compound which is used as the catalyst component (b).

Specific examples of the electron donor (c) can be selected from the compounds described above as examples of the electron donor to be contained in the titanium catalyst component (a). Among these, it is preferred to use, for example, an organic acid ester, an alkoxy (aryloxy) silane compound, an ether, a ketone, an acid anhydride or an amine. In cases where the electron donor in the titanium catalyst component (a) is a monocarboxylic acid ester, in particular, the electron donor component (c) is preferably an alkyl ester of an aromatic carboxylic acid.

Further, in cases where the electron donor in the titanium catalyst component (a) is an ester obtained by allowing an dicarboxylic acid to react with an alcohol having two or more carbon atoms, it is preferred to use an alkoxy (aryloxy) silane compound represented by the formula: $R_nSi(OR^1)_{4-n}$ (wherein each of R and $R^1$ represents a hydrocarbon group; and n satisfies $0\leq n\leq 4$) or an amine with a large steric hindrance, as the electron donor component (c).

Among the alkoxy (aryloxy) silane compounds, particularly preferred is trimethylmethoxysilane, trimethylethoxysilane, trimethyl-n-propoxysilane, triethylmethoxysilane, tri-n-propylmethoxysilane, tri-iso-propylmethoxysilane or triphenylmethoxysilane.

Examples of the amine with a large steric hindrance include 2,2,6,6-tetramethylpiperidine and 2,2,5,5-tetramethylpyrrolidine; derivatives thereof; and tetramethylmethylenediamine.

In the description given below, the term "polymerization" is used to refer to homopolymerization or copolymerization.

In the present invention, polymerization is usually carried out in a hydrocarbon solvent, as an inert medium. Examples of such an inert medium include: aliphatic hydrocarbons such as propane, butane, pentane, hexane, heptane, octane, decane and kerosene; alicyclic hydrocarbons such as cyclopentane and cyclohexane; aromatic hydrocarbons such as benzene, toluene and xylene; halogenated hydrocarbons such as dichloroethane, methylenechloride and chlorobenzene; and mixtures thereof. Among these, in particular, an aliphatic hydrocarbon is preferably used.

Further, 4-methyl-1-pentene, which is a monomer, may be used as the hydrocarbon solvent, instead of the inert medium, and polymerization can be carried out in the monomer. Alternatively, both the monomer and the inert medium may be used in combination.

In the present invention, the production of the 4-methyl-1-pentene polymer (A) is carried out in the presence of the catalyst as described above. Before carrying out such a polymerization, which is namely the main polymerization, a preliminary polymerization such as one described below may be carried out.

In the preliminary polymerization, an olefin(s) in an amount of from 1 to 1,000 g per 1 millimole of titanium in the titanium catalyst component (a), are allowed to react in the hydrocarbon medium as described above, using a catalyst formed from the titanium catalyst component (a), at least a portion of the organoaluminum compound catalyst component (b) and at least a portion of the electron donor component (c).

The olefin(s) to be used in the preliminary polymerization is/are usually an α-olefin(s) having from 5 to 10 carbon atoms and having branches at three or more positions, but not particularly limited thereto. Specific examples thereof include 3-methyl-1-pentene, 4-methyl-1-pentene, 3-methyl-1-butene, 3,3-dimethyl-1-butene, 4,4-dimethyl-1-hexene, 3-methyl-1-hexene, 4,4-dimethyl-1-pentene, 3-ethyl-pentene and vinylcyclohexane, which are used in the main polymerization to be described later.

In cases where the main polymerization is carried out after carrying out the preliminary polymerization as described above, the organoaluminum compound catalyst component (b) and/or the electron donor component (c) may additionally be added during the main polymerization. In this case, the organoaluminum compound catalyst component (b) may be additionally added in an amount of usually from 1 to 1,000 moles, and preferably from 10 to 1,000 moles per 1 mole of titanium, and the electron donor component (c) may be additionally added in an amount of usually from 0.005 to 2 moles, and preferably from 0.01 to 1 mole per 1 mole of the organic aluminum catalyst component (b).

In addition, hydrogen or a halogenated hydrocarbon, for example, may be allowed to coexist in the polymerization system, in order to adjust the molecular weight, the molecular weight distribution, etc.

In the present invention, polymerization is preferably carried out by suspension polymerization, at a polymerization temperature which is within the range where the suspension polymerization can be carried out and which is 0° C. or higher, and preferably within the range of from 25 to 70° C. Further, it is desired that the polymerization be carried out at a polymerization pressure, for example, within the range of from atmospheric pressure to 20 MPa, and preferably from atmospheric pressure to 10 MPa. The polymerization time is preferably set such that the amount of (co) polymer produced is 1,000 g or more, and preferably 5,000 g or more per 1 millimole of titanium in the titanium catalyst component. Further, the main polymerization may be carried out in single stage, or in multiple stages.

In the present invention, polymerization proceeds in a hydrocarbon solvent, in a state of a slurry, namely, in a suspended state. As the polymerization proceeds, a polymer solution is obtained which contains: the 4-methyl-1-pentene polymer (A) which is soluble in the hydrocarbon solvent which is a polymerization solvent; and a 4-methyl-1-pentene polymer which is a solid component insoluble in the hydrocarbon solvent used as the polymerization solvent. The resulting polymer solution is introduced into a solid-liquid separation apparatus, and separated into a polymer solution in which the 4-methyl-1-pentene polymer (A) is dissolved, and a solid component of the 4-methyl-1-pentene polymer. The separation of the solid component of the 4-methyl-1-pentene polymer (A) from the polymer solution can be carried out by a conventionally known separation method, such as centrifugal separation or filtration. From the separated polymer solution, the 4-methyl-1-pentene polymer (A) can be obtained by precipitation. The method of precipitation can be selected arbitrarily, and it is possible to use, for example, a method in which a thin film evaporator is used, or a method in which a two-phase flow evaporator with piston flow properties is used. Although a plurality of precipitation methods may be used in combination, it is suitable to use at least a two-phase flow evaporator with piston flow properties, in particular.

The "evaporator with piston flow properties" refers to an evaporator in which a liquid to be evaporated flows in a certain direction from the upstream of the apparatus toward the downstream thereof. Further, the "two-phase flow evaporator" refers to an evaporator in which flows of at least two phases, namely, either gas and liquid phases or gas and solid phases exist. Alternatively, three phases of gas, liquid and solid may coexist in the evaporator.

Representative examples thereof include kneaders and double pipe heat exchangers. Among these, particularly preferred is a pipe evaporator in which at least one flow condition selected from a wavy flow, a slug flow, an annular flow and a mist flow is formed. Further, most preferred is an apparatus in which the above described flow condition is formed by a gas generated inside the evaporator. For example, a double pipe flash dryer is suitably used.

The double pipe flash dryer is a heat exchanger equipped with double pipes, including: an outer pipe for allowing a heating medium to flow therethrough; and an inner pipe for allowing the polymer solution from which the 4-methyl-1-pentene polymer (A) has been separated and collected, to flow therethrough. As the heating medium, it is possible to use, for example, steam, an electric heating device, a hot oil or Dowtherm.

Although the flow condition inside the double pipe flash dryer varies depending on factors such as the temperature, concentration and pressure of the remaining polymer solution from which the 4-methyl-1-pentene polymer (A) has been separated and collected, and which is to be introduced into the double pipe flash dryer, the polymer solution goes through the following flow conditions.

Specifically, inside the double pipe flash dryer, volatile components evaporate as a result of being heated by a heating medium such as steam, to cause the formation of a bubbly flow etc., and thereafter, the formation of a wavy flow, a slug flow, an annular flow, and/or a mist flow. It is to be noted, however, that the above described process varies depending on factors such as the temperature, concentration and pressure of the remaining polymer solution from which the 4-methyl-1-pentene polymer (A) has been separated and collected, and which is to be introduced into the double pipe flash dryer, as well as on factors such as the temperature distribution, concentration distribution, and pressure distribution inside the double pipe flash dryer.

These flow conditions in the two-phase flow evaporator with piston flow properties are generated by the following mechanism: in the evaporator, volatile components are evaporated to cause volume expansion, which in turn accelerates the movement of the fluid inside the evaporator, thereby generating such flow conditions. By this mechanism, even when the volatile components are evaporated to cause an increase in the viscosity, it is possible to achieve the separation of the volatile components without causing the heat exchanger to clog due to the kinetic energy of the gas phase generated by the evaporation.

Further, in the evaporator with piston flow properties, the applied heat is immediately consumed by the latent heat, and a temperature increase inside the evaporator is prevented so that a heat source needed for the evaporation can be maintained at a low temperature. This enables to reduce the energy cost per unit.

In addition, continuous evaporation of the volatile components enables boiling heat transfer to occur, and further, the above described volume expansion increases the linear velocity of the fluid inside the evaporator to an extremely high level. As a result, surface renewal at the heat transfer interface can be accelerated, and a high heat transfer efficiency can be obtained due to the acceleration of the surface renewal and the utilization of the boiling heat transfer.

In a conventionally and commonly used thin film evaporator, a high torque load is applied on a driving device, such as a motor, as the polymer solution is concentrated during the process of separating and collecting the 4-methyl-1-pentene polymer (A) from the polymer solution from which the solid component of the 4-methyl-1-pentene polymer has been separated, resulting in an increase in the cost of facility. Further, it is difficult to reduce the amount of the hydrocarbon solvent remaining in the resulting 4-methyl-1-pentene polymer (A). In contrast, the double pipe flash dryer does not include a driving device, and thus allows for an easy and low-cost facility maintenance. In addition, it is possible to reduce the amount of the hydrocarbon solvent remaining in the resulting 4-methyl-1-pentene polymer (A). Moreover, the double pipe flash dryer is suitable for a drying treatment of a material which is sensitive to heat, since it enables to carry out drying in an extremely short period of time.

In the case of flash drying the polymer solution using the double pipe flash dryer, it is preferred that the concentration of the 4-methyl-1-pentene polymer (A) in the polymer solution from which the solid component of the 4-methyl-1-pentene polymer has been separated, be usually adjusted within the range of from 1 to 30% by mass. Although the polymer solution may be preheated, the solution is usually heated by the double pipe flash dryer.

The heating is preferably carried out at a heating temperature which is high enough for allowing the solvent in the polymer solution to evaporate sufficiently. At the same time, the heating temperature is preferably adjusted so as to provide the polymer solution with a quantity of heat which prevents the solidification of the 4-methyl-1-pentene polymer (A) in the polymer solution inside the double pipe flash dryer, namely, a quantity of heat which enables the polymer solution to be heated at least to a flowable temperature. In general, the heating temperature is preferably adjusted so as to provide a quantity of heat so that the temperature of the 4-methyl-1-pentene polymer (A) at the outlet of the double pipe flash dryer is from 100 to 400° C., preferably from 100 to 300° C., more preferably from 130 to 250° C., and particularly preferably from 140 to 250° C. It is preferred that the heating temperature be higher than the above described lower limit temperature, because it allows the 4-methyl-1-pentene polymer (A) to flow in the double pipe flash dryer without solidifying. Further, it is preferred that the heating temperature be equal to or lower than the above described upper limit value, because it enables to prevent the thermal degradation of the polymer (A).

Further, the quantity of heat to be applied can be set as appropriate, depending on factors such as: the type of the hydrocarbon solvent used; the heat transfer area of the double pipe flash dryer; the pressure distribution in the dryer; and the processing speed at which the polymer solution is processed.

In the present invention, the polymer solution which has preferably been subjected to a heating step as described above is flash dried, and then separated into: the hydrocarbon solvent which is the polymerization solvent that has been evaporated; unreacted olefins, etc.; and the 4-methyl-1-pentene polymer (A); by a drum, for example, provided at the outlet of the double pipe flash dryer.

In the case of flash drying the polymer solution from which the solid component of the 4-methyl-1-pentene polymer has been separated, in the above described manner, it is desirable that the linear velocity at the inlet of the double pipe flash dryer be from 0.03 to 30 m/sec, and preferably from 0.1 to 10 m/sec; and that the gas superficial linear velocity at the outlet of the double pipe flash dryer be from 3 to 30,000 m/sec, and preferably from 10 to 10,000 m/sec.

By carrying out the flash drying of the remaining polymer solution from which the solid component of the 4-methyl-1-pentene polymer has been separated, under the above described conditions, it is possible to obtain the 4-methyl-1-pentene polymer (A) from which unreacted olefins, partially remaining solvent and other components are substantially removed. The thus obtained 4-methyl-1-pentene polymer (A) has excellent properties such as flexibility, adhesion, heat resistance and dispersibility, and is also useful in that the polymer is obtained as a byproduct in the production of the solid component of the 4-methyl-1-pentene polymer. Although the 4-methyl-1-pentene polymer (A) obtained by the above described flash drying can be used as it is, the polymer is preferably purified, for example, by re-precipitation or thin film distillation, before use.

<Additive Composition for Lubricating Oils>

The additive composition for lubricating oils according to the present invention contains from 1 to 50 parts by mass of the viscosity modifier for lubricating oils containing the 4-methyl-1-pentene polymer (A) according to the present invention, and from 50 to 99 parts by mass of an oil (B2) (with the proviso that the total amount of the viscosity modifier for lubricating oils and the oil (B2) is taken as 100 parts by mass). Preferably, the additive composition for lubricating oils contains from 2 to 40 parts by mass of the viscosity modifier for lubricating oils and from 60 to 98 parts by mass of the oil (B2), and more preferably from 3 to 30 parts by mass of the viscosity modifier for lubricating oils and from 70 to 97 parts by mass of the oil (B2).

Examples of the oil (B2) to be contained in the additive composition for lubricating oils include mineral oils; and synthetic oils such as poly-α-olefins, diesters and polyalkylene glycols.

As the base oil (B2) according to the present invention, a mineral oil or a blend of a mineral oil and a synthetic oil may be used. Examples of diesters include polyol esters, dioctyl phthalate and dioctyl sebacate.

The mineral oil according to the present invention is usually subjected to a purification process such as dewaxing before use, and can be classified into several grades depending on the method of purification used. In general, a mineral oil having a wax content of from 0.5 to 10% is used, as the mineral oil according to the present invention. For example, it is also possible to use a highly purified oil produced by hydrocracking refining, composed mainly of isoparaffin, and having a low pour point and a high viscosity index. A mineral oil having a kinematic viscosity at 40° C. of from 10 to 200 $mm^2/s$ is generally used.

As described above, the mineral oil according to the present invention is usually subjected to a purification process such as dewaxing before use, and can be classified into several grades depending on the method of purification used, which grades are defined by API (American Petroleum Institute) classification. The properties of lubricating oil bases which are classified into respective groups are shown in the above described Table 1.

The oil (B2) to be used in the present invention is preferably an oil belonging to any one of the groups (i) to (iv). In particular, the oil (B2) is preferably a mineral oil having a kinematic viscosity at 100° C. of from 1 to 50 $mm^2/s$ and a viscosity index of 80 or more; or a poly-α-olefin. Further, the oil (B2) is preferably a mineral oil belonging to the group (ii) or the group (iii), or a poly-α-olefin belonging to the group (iv). Mineral oils in the group (ii) and the group (iii) tend to have a lower wax concentration as compared to those in the group (i). In particular, the oil (B2) is preferably a mineral oil having a kinematic viscosity at 100° C. of from 1 to 50 $mm^2/s$ and a viscosity index of 80 or more, and belonging to the group (ii) or the group (iii); or a poly-α-olefin belonging to the group (iv).

Further, the additive composition for lubricating oils according to the present invention may contain any other components (additives) other than the 4-methyl-1-pentene polymer (A) and the oil (B2). As the other components, the lubricating oil composition may optionally contain any one or more of the materials to be described later, for example.

<Detergent>

One of such additives is a detergent. Many of conventional detergents used in the field of engine lubrication provide basicity or TBN to lubricating oils, by the presence of a basic metal compound (a metal hydroxide, a metal oxide or a metal carbonate, which is typically based on a metal such as calcium, magnesium, or sodium) contained therein. Such metallic overbased detergents (also referred to as overbased salts or superbased salts) are generally single phase, homogeneous Newtonian systems characterized by a metal content in excess of that which would be present for neutralization according to the stoichiometry of the metal and a particular acidic organic compound reacted with the metal. The overbased materials are typically prepared by allowing an acidic material (typically, an inorganic acid or lower carboxylic acid, such as carbon dioxide) to react with a mixture of an acidic organic compound (also referred to as a substrate) and a stoichiometric excess of a metal salt, typically in an organic solvent (such as a mineral oil, naphtha, toluene, or xylene) which is inert to the acidic organic substrate. Optionally, a small amount of a promoter such as a phenol or alcohol is contained. The acidic organic substrate will normally have a sufficient number of carbon atoms to provide a certain degree of solubility in oil.

Such conventional overbased materials and methods for preparing these materials are well known to those skilled in the art. Examples of patents describing techniques for producing basic metal salts of sulfonic acids, carboxylic acids, phenols, phosphoric acids, and mixtures of two or more of these include U.S. Pat. Nos. 2,501,731; 2,616,905; 2,616, 911; 2,616,925; 2,777,874; 3,256,186; 3,384,585; 3,365,396; 3,320,162; 3,318,809; 3,488,284; and 3,629,109. Salixarate detergents are described in U.S. Pat. No. 6,200,936 and WO 01/56968. Saligenin detergents are described in U.S. Pat. No. 6,310,009.

A typical amount of detergent to be contained in the additive composition for lubricating oils according to the present invention is usually from 1 to 10% by mass, preferably from 1.5 to 9.0% by mass, and more preferably from 2.0 to 8.0% by mass, but not particularly limited thereto as long as the effect of the present invention can be obtained. The values of the above described amount are all expressed on an oil-free basis (namely, a state where a diluent oil conventionally contained in such a detergent is absent).

<Dispersant>

Another additive is a dispersant. Dispersants are well known in the field of lubricating oils, and examples thereof include primarily those known as ashless dispersants and polymeric dispersants. Ashless dispersants are characterized by a polar group attached to a hydrocarbon chain having a relatively high molecular weight. Examples of typical ashless dispersants include nitrogen-containing dispersants such as N-substituted long-chain alkenyl succinimides, which are also known as succinimide dispersants. Succinimide dispersants are more fully described in U.S. Pat. Nos. 4,234,435 and 3,172,892. Another class of ashless dispersants is high molecular weight esters prepared by the reaction of a polyvalent aliphatic alcohol such as glycerol, pentaerythritol or sorbitol with a hydrocarbyl acylating agent. U.S. Pat. No. 3,381,022 describes such materials in detail. Still another class of ashless dispersants is Mannich bases. These are materials formed by the condensation of a higher molecular weight alkyl-substituted phenol, an alkylene polyamine, and an aldehyde such as formaldehyde, and are described in more detail in U.S. Pat. No. 3,634,515. Examples of other dispersants include polyvalent additives having dispersibility, which are generally hydrocarbon-based polymers that contain polar functionality to impart dispersive properties to the polymer.

Dispersants may be post-treated by allowing them to react with any of a variety of substances. Examples of these substances include urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatments can be found in U.S. Pat. No. 4,654,403. The amount of dispersant to be contained in the additive composition for lubricating oils according to the present invention is not particularly limited as long as the effect of the present invention can be obtained, and the amount thereof may typically be from 1 to 10% by mass, preferably from 1.5 to 9.0% by mass, and more preferably from 2.0 to 8.0% by mass (all values are expressed on an oil-free basis).

<Antioxidant>

Still another component is an antioxidant. Antioxidants encompass phenolic antioxidants, which may include a butyl-substituted phenol containing two or three t-butyl groups. The para position may be occupied by a hydrocarbyl group or a group bridging two aromatic rings. The antioxidants of the latter type are described in greater detail in U.S. Pat. No. 6,559,105. Antioxidants also include aromatic amines such as nonylated diphenylamines. Examples of other antioxidants include sulfurized olefins, titanium compounds, and molybdenum compounds. For example, U.S. Pat. No. 4,285,822 discloses lubricating oil compositions containing a molybdenum and sulfur containing composition. A typical amount of antioxidant to be contained in the additive composition for lubricating oils according to the present invention will, of course, vary depending on the specific type and the effectiveness of each antioxidant used. Illustratively, the total amount thereof may be from 0.01 to 5% by mass, preferably from 0.15 to 4.5% by mass, and more preferably from 0.2 to 4% by mass. Further, one or more antioxidants may be contained, and certain combinations of these can be synergistic in their combined overall effect.

<Thickener>

The additive composition for lubricating oils according to the present invention may also contain a thickener (sometimes referred to as a viscosity index improver or a viscosity modifier). The thickener to be used is usually a polymer, and examples thereof include polyisobutenes, polymethacrylic acid esters, diene polymers, polyalkyl styrenes, esterified styrene-maleic anhydride copolymers, alkenyl arene-conjugated diene copolymers and polyolefins. Multifunctional thickeners which also have dispersibility and/or antioxidative properties are well known, and any of these may optionally be used.

The thickener may be contained in the additive composition for lubricating oils according to the present invention, usually in an amount of from 0.1 to 25.0% by mass, preferably from 0.2 to 20.0% by mass, more preferably from 0.3 to 15.0% by mass, and still more preferably from 0.5 to 10.0% by mass, but not particularly limited thereto as long as the effect of the present invention can be obtained.

<Extreme Pressure Agent>

Another additive is an extreme pressure agent. Examples of the extreme pressure agent include: sulfur-based extreme pressure agents such as sulfides, sulfoxides, sulfones, thiophosphinates, thiocarbonates, sulfurized fats and oils and sulfurized olefins; phosphoric acids such as phosphoric acid esters, phosphorous acid esters, phosphoric acid ester amine salts and phosphorous acid ester amines; and halogen compounds such as chlorinated hydrocarbons. In a specific embodiment, the extreme pressure agent may be contained in the additive composition for lubricating oils according to the present invention, usually in an amount of from 0.01 to 5.0% by mass, preferably from 0.015 to 3.0% by mass, more preferably from 0.02 to 2.0% by mass, and still more preferably from 0.025 to 1.0% by mass, but not particularly limited thereto as long as the effect of the present invention can be obtained.

<Anti-Wear Agent>

Another additive is an anti-wear agent. Examples of the anti-wear agent include phosphorus-containing anti-wear/extreme pressure agents, such as metal thiophosphates, phosphoric acid esters and salts thereof, phosphorus-containing carboxylic acids, esters, ethers and amides; and phosphites. In a specific embodiment, a phosphorus anti-wear agent may be contained in the additive composition for lubricating oils according to the present invention, in an amount to give usually from 0.01 to 0.2% by mass, preferably from 0.015 to 0.15% by mass, more preferably from 0.02 to 0.1% by mass, and still more preferably from 0.025 to 0.08% by mass of phosphorus. However, the amount thereof to be contained in the additive composition for lubricating oils is not particularly limited as long as the effect of the present invention can be obtained.

The anti-wear agent is a zinc dialkyldithiophosphate (ZDP), in many cases. A typical ZDP may contain 11% by mass of P (calculated on an oil-free basis), and a suitable amount thereof may be, for example, from 0.09 to 0.82% by mass. Examples of anti-wear agents which do not contain phosphorus include boric acid esters (including borated epoxides), dithiocarbamate compounds, molybdenum-containing compounds, and sulfurized olefins.

Examples of other additives which may be optionally contained in the additive composition for lubricating oils according to the present invention, in addition to the above described extreme pressure agents and anti-wear agents, include pour point depressants, friction modifiers, color stabilizers, and anti-foaming agents. Each of these may be used in a conventional amount.

The additive composition for lubricating oils according to the present invention preferably contains the 4-methyl-1-pentene polymer (A) and the oil (B2) in amounts within the above described respective ranges. In the case of producing a lubricating oil composition, using the additive composition for lubricating oils which contains the 4-methyl-1-pentene polymer (A) and the oil (B2) in amounts within the above described respective ranges, it is possible to obtain a lubricating oil composition having excellent low temperature properties with a low content of the polymer (A), by mixing the additive composition for lubricating oils and other components of the lubricating oil composition.

Due to containing the oil (B2), the additive composition for lubricating oils according to the present invention provides a good workability during the production process of the lubricating oil composition, and can be easily mixed with other components of the lubricating oil composition.

The additive composition for lubricating oils according to the present invention can be prepared by a conventionally known method, by mixing the 4-methyl-1-pentene polymer (A) and the oil (B2), optionally with other desired components. Since the 4-methyl-1-pentene polymer (A) is easy to handle, it may optionally be supplied as a concentrate in an oil.

<Lubricating Oil Composition>

The lubricating oil composition according to the present invention contains from 0.1 to 5 parts by mass of the viscosity modifier for lubricating oils according to the present invention, and from 95 to 99.9 parts by mass of a lubricating oil base (BB) (with the proviso that the total amount of the viscosity modifier for lubricating oils and the lubricating oil base (BB) is taken as 100 parts by mass). The lubricating oil composition according to the present invention preferably contains the viscosity modifier for lubricating oils at a ratio of from 0.2 to 4 parts by mass, more preferably from 0.4 to 3 parts by mass, and still preferably from 0.6 to 2 parts by mass, and preferably contains the lubricating oil base (BB) at a ratio of from 96 to 99.8 parts by mass, more preferably from 97 to 99.6 parts by mass, and still more preferably from 98 to 99.4 parts by mass, with respect to the total amount described above. The viscosity modifier for lubricating oils according to the present invention may be used alone, or a plurality of these viscosity modifiers can be used in combination.

The lubricating oil composition according to the present invention may further contain a pour point depressant (C). The content of the pour point depressant (C) is usually from 0.05 to 5% by mass, preferably from 0.05 to 3% by mass, more preferably from 0.05 to 2% by mass, and still more preferably from 0.05 to 1% by mass, in 100% by mass of the lubricating oil composition, but not particularly limited thereto as long as the effect of the present invention can be obtained.

When the content of the viscosity modifier for lubricating oils according to the present invention in the lubricating oil composition according to the present invention is within the above mentioned range, the resulting lubricating oil composition has excellent low temperature storage properties and low temperature viscosity, and thus is particularly useful.

Examples of the lubricating oil base (BB) to be contained in the lubricating oil composition according to the present invention include: mineral oils; and synthetic oils such as poly-α-olefins, diesters and polyalkylene glycols; as shown in the above described Table 1.

A mineral oil or a blend of a mineral oil and a synthetic oil may be used. Examples of diesters include polyol esters, dioctyl phthalate, dioctyl sebacate, and the like.

Mineral Oil

Mineral oils are usually subjected to a purification process such as dewaxing before use, and are classified into several grades depending on the method of purification used. In general, a mineral oil having a wax content of from 0.5 to 10% by mass is used. For example, it is also possible to use a highly purified oil produced by hydrocracking refining, composed mainly of isoparaffin, and having a low pour point and a high viscosity index. A mineral oil having a kinematic viscosity at 40° C. of from 10 to 200 $mm^2/s$ is generally used.

As described above, mineral oils are usually subjected to a purification process such as dewaxing before use, and are classified into several grades depending on the method of purification used, which grades are defined by API (American Petroleum Institute) classification. The properties of lubricating oil bases which are classified into respective groups are as shown in Table 1 above.

The "Poly-α-olefin" in Table 1 represents a group of hydrocarbon polymers obtained by polymerizing at least one α-olefin having 10 or more carbon atoms as a raw material monomer, and examples thereof include polydecenes obtained by polymerizing 1-decene.

The lubricating oil base (BB) to be used in the present invention may be an oil belonging to any one of the group (i) to the group (iv). In one embodiment, the above described oil is a mineral oil having a kinematic viscosity at 100° C. of from 1 to 50 $mm^2/s$ and a viscosity index of 80 or more, or a poly-α-olefin. Further, the lubricating oil base (BB) is preferably a mineral oil belonging to the group (ii) or the group (iii), or a poly-α-olefin belonging to the group (iv). Mineral oils in the group (ii) and the group (iii) tend to have a lower wax concentration as compared to those in the group (i).

In particular, the lubricating oil base (BB) is preferably a mineral oil having a kinematic viscosity at 100° C. of from 1 to 50 $mm^2/s$ and a viscosity index of 80 or more, and belonging to the group (ii) or the group (iii); or a poly-α-olefin belonging to the group (iv).

Examples of the pour point depressant (C) which may be contained in the lubricating oil composition according to the present invention include alkylated naphthalenes, (co)polymers of alkyl methacrylates, (co)polymers of alkyl acrylates, copolymers of alkyl fumarates and vinyl acetate, α-olefin polymers, and copolymers of α-olefins and styrene. In particular, a (co)polymer of an alkyl methacrylate or a (co)polymer of an alkyl acrylate may be used.

The lubricating oil composition according to the present invention may contain compounding agents (additives), in addition to the above described viscosity modifier for lubricating oils, the above described lubricating oil base (BB) and the pour point depressant (C).

In cases where the lubricating oil composition according to the present invention contains any compounding agents, the content thereof is not particularly limited. However, the content of the compounding agents is usually more than 0% by mass, preferably 1% by mass or more, more preferably 3% by mass or more, and still more preferably 5% by mass or more, with respect to 100% by mass of the total amount of the lubricating oil base (BB) and the compounding agents. At the same time, the content of the compounding agents is usually 40% by mass or less, preferably 30% by mass or less, more preferably 20% by mass or less, and still more preferably 15% by mass or less.

Examples of the compounding agents (additives) include additives which are different from the lubricating oil base (BB) and the pour point depressant (C), such as those described above in detail in the section of the additive composition for lubricating oils. Specific examples include: additives having an effect of improving the viscosity index, such as hydrogenated SBR (styrene butadiene rubbers) and SEBS (styrene-ethylene-butylene-styrene block copolymers); detergents; additives for rust prevention; dispersants; extreme pressure agents; antifoaming agents; antioxidants; metal inactivating agents; and the like.

The lubricating oil composition according to the present invention can be prepared by a conventionally known method, by mixing and dissolving the viscosity modifier for lubricating oils according to the present invention, the lubricating oil base (BB), the pour point depressant (C), and any of other compounding agents (additives), as necessary.

The lubricating oil composition according to the present invention is excellent in low temperature storage properties and low temperature viscosity. Therefore, the lubricating oil composition according to the present invention can be used to lubricate any of various types of known mechanical equipment, for example, as a lubricating oil for gasoline engines, a lubricating oil for diesel engines, a lubricating oil for marine vessel engines, a lubricating oil for two-stroke engines, a lubricating oil for automatic or manual transmissions, a lubricating oil for gears, grease, or the like.

EXAMPLES

The present invention will now be specifically described based on Examples. However, the present invention is in no way limited to these Examples.

In the following Production Examples 1 to 13, Examples 1 to 9, and Comparative Examples 1 to 4, respective physical properties were measured and evaluated by the methods described below. The evaluation results of the resulting copolymers are shown in Table 2, and the evaluation results of the resulting lubricating oil compositions are shown in Table 3. In Table 2 and Table 3, the description "-" means "not detected".

[DSC Measurement]

DSC measurement of each of the resins to be produced in Examples 1 to 9 and Comparative Examples 1 to 4 is carried out using a differential scanning calorimeter (X-DSC7000) manufactured by Seiko Instruments Inc. and calibrated with indium standard.

About 10 mg of the above described measurement sample is weighed into a DSC pan made of aluminum. A cover is crimped to the pan and the sample is left in a closed atmosphere, to give a sample pan.

The sample pan is disposed in a DSC cell, and an empty aluminum pan is placed as a reference. The temperature of the DSC cell is increased from 30° C. (room temperature) to 150° C. at a rate of 10° C./min under a nitrogen atmosphere (a first heating process).

After maintaining at 150° C. for 5 minutes, the temperature is decreased at a rate of 10° C./min to cool the DSC cell to −100° C. (cooling process). After maintaining at −100° C. for 5 minutes, the temperature is increased at a rate of 10° C./min to heat the DSC cell to 150° C. (a second heating process).

In an enthalpy curve obtained during the second heating process, the intersection of the tangent line of the linear portion of the enthalpy curve immediately before the curve slopes toward the endothermic side for the first time, and the tangent line of the linear portion of the enthalpy curve immediately after the slope, is defined as the glass transition temperature (Tg). Further, the peak top temperature of the melting peak in the enthalpy curve obtained during the second heating process is defined as the melting point (Tm). In cases where two or more melting peaks are observed, the peak top temperature of the highest peak is defined as the Tm.

[Intrinsic Viscosity [η] (dL/g)]

Intrinsic viscosity [η] of the polymer was measured using a decalin solvent at 135° C. Specifically, 20 mg of powder, pellets or resin block of the polymer was dissolved in 15 ml of decalin, and the specific viscosity ηsp of the resulting solution was measured in an oil bath at a temperature of 135° C. To the resulting decalin solution, 5 ml of the decalin solvent was further added for dilution, and then the specific viscosity ηsp was measured in the same manner. The above described dilution operation was repeated two more times, and the value of ηsp/C obtained when a concentration (C) was extrapolated to 0 was defined as the intrinsic viscosity (see the following equation).

$$[\eta]=\lim(\eta sp/C)(C\rightarrow 0)$$

[Density]

Density of each of the resins to be produced or used in Examples 1 to 9 and Comparative Examples 1 to 4 is measured in accordance with the method described in JIS K7112.

[GPC Measurement]

Weight average molecular weight and molecular weight distribution of each of the copolymers to be produced or used in Examples 1 to 9 and Comparative Examples 1 to 4 are measured according to the method described below.

(Pre-Treatment of Sample)

A quantity of 30 mg of each of the copolymers to be produced or used in Examples 1 to 9 and Comparative Examples 1 to 4 is dissolved in 20 ml of o-dichlorobenzene at 145° C., and a resulting solution is then filtered through a sintered filter having a pore diameter of 1.0 μm. The resulting filtrate is used as an analysis sample.

(GPC Analysis)

Weight average molecular weight (Mw), number average molecular weight (Mn), and molecular weight distribution curve of the analysis sample are determined using gel permeation chromatography (GPC). The calculations are carried out in terms of polystyrene. Mw/Mn is calculated from the thus determined weight average molecular weight (Mw) and number average molecular weight (Mn).

(Measuring Apparatus)

Gel permeation chromatograph, HLC-8321, Type GPC/HT (manufactured by Tosoh Corporation)

(Analysis Apparatus)

Data processing software, Empower 2 (registered trademark, manufactured by Waters Corporation)

(Measurement Conditions)

Columns: two TSKgel $GMH_6$-HT columns, and two TSKgel $GMH_6$-HTL columns (each having a diameter of 7.5 mm and a length of 30 cm, manufactured by Tosoh Corporation).

Column temperature: 140° C.

Mobile phase: o-dichlorobenzene (containing 0.025% BHT)

Detector: differential refractometer

Flow rate: 1 mL/min

Sample concentration: 0.15% (w/v)

Injection volume: 0.4 mL

Sampling time interval: 1 second

Column calibration: monodisperse polystyrene (manufactured by Tosoh Corporation)

Molecular weight conversion: PS conversion/standard conversion method

[Contents of Structural Units]

The contents (% by mole) of the structural unit derived from ethylene and the structural units derived from α-olefins contained in each of the copolymers to be produced or used in Examples 1 to 9 and Comparative Examples 1 to 4 are determined by $^{13}$C-NMR spectral analysis.

It is noted that, in Table 2, "C2" represents the structural unit derived from ethylene, "C3" represents the structural unit derived from propylene, and "4MP-1" represents the structural unit derived from 4-methyl-1-pentene.

(Measuring Apparatus)

AVANCE III 500 CryoProbe Prodigy nuclear magnetic resonance apparatus, manufactured by Bruker BioSpin GmbH.

(Measurement Conditions)

Nucleus measured: $^{13}$C (125 MHz); Measurement mode: single pulse proton broadband decoupling; Pulse width: 45° (5.00 μsec); Number of points: 64 k; Measurement range: 250 ppm (−55 to 195 ppm); Repetition time: 5.5 sec; Number of scans: 512 times; Solvent for measurement: o-dichlorobenzene/benzene-$d_6$ (4/1 v/v); Sample concentration: ca. 60 mg/0.6 mL; Measurement temperature: 120° C.; Window function: exponential (BF: 1.0 Hz); and Chemical shift reference: benzene-$d_6$ (128.0 ppm).

Preparation of Mineral Oil-containing Lubricating Oil Composition

An engine oil (lubricating oil composition) containing a viscosity modifier for lubricating oils is prepared. The lubricating oil composition contains the following components:

API group III base oil: from 90.40 to 90.94 (% by mass)

Additive*: 8.15 (% by mass)

Pour point depressant (polymethacrylate): 0.3 (% by mass)

Copolymer: from 0.49 to 1.15 (as shown in Table 3) (% by mass)

Total: 100.0 (% by mass)

Note: *additive=a conventional additive package for engine lubricating oils, including: Ca and Na overbased detergents; N-containing dispersant; aminic and phenolic antioxidants; zinc dialkyldithiophosphate; friction modifier; and antifoaming agent.

To the group III oil is added the viscosity modifier for lubricating oils (copolymer) obtained in each of the Examples and Comparative Examples, as a concentrate. The content (% by mass) of the copolymer in each of the resulting lubricating oil compositions is shown in Table 3.

[Shear Stability Index (SSI)]

SSI of each of the mineral oil-containing lubricating oil compositions to be prepared in Examples 1 to 9 and Comparative Examples 1 to 4 is measured by the ultrasonic wave method referencing JPI-5S-29-88. Each of the lubricating oil compositions is irradiated with ultrasonic waves, and the SSI is determined from the rate of decrease in kinematic viscosity before and after the irradiation. The SSI is a measure of a decrease in kinematic viscosity resulting from the breakage of molecular chains when the copolymer components in the lubricating oil are subjected to shear under sliding conditions. A higher SSI value indicates a larger decrease in kinematic viscosity.

(Measuring Apparatus)

US-300TCVP ultrasonic wave shear stability tester (manufactured by PrimeTech Ltd.)

(Measurement Conditions)

Oscillatory frequency: 10 KHz

Test temperature: 40° C.

Position of irradiation horn: 2 mm below the liquid level (Measurement Method)

A quantity of 30 ml of sample is collected and placed into a sample container, and the container is then irradiated with ultrasonic waves at an output voltage of 4.2 V for 30 minutes. The kinematic viscosity at 100° C. of the sample oil is measured before and after the irradiation of ultrasonic waves, and the SSI is determined according to the formula shown below:

$$\text{SSI}\ (\%)=100\times(Vo-Vs)/(Vo-Vb)$$

Vo: kinematic viscosity ($mm^2/s$) at 100° C. before ultrasonic irradiation

Vs: kinematic viscosity ($mm^2/s$) at 100° C. after ultrasonic irradiation

Vb: kinematic viscosity ($mm^2/s$) at 100° C. of the engine oil (lubricating oil composition) in which the component amount of the viscosity modifier for lubricating oils is adjusted to 0% by mass

[Kinematic Viscosity (KV)]

Kinematic viscosity at 100° C. of each of the lubricating oil compositions to be prepared in Examples 1 to 9 and Comparative Examples 1 to 4 is measured in accordance with ASTM ASTMD446.

[Cold Cranking Simulator (CCS) Viscosity]

CCS viscosity (at −30° C.) of each of the mineral oil-containing lubricating oil compositions prepared in Examples and Comparative Examples is measured in accordance with ASTM D2602. The CCS viscosity is used to evaluate the slidability (startability) of a crank shaft at a low temperature. A lower value indicates a better low temperature viscosity (low temperature properties) of the lubricating oil.

When lubricating oil compositions are produced at compositions adjusted to achieve approximately the same kinematic viscosity at 100° C., and compared between the lubricating oil compositions having approximately the same SSI, a lubricating oil composition with a lower CCS viscosity has a better fuel saving performance at a low temperature (low temperature startability).

[Mini-Rotary Viscosity (MRV, MR Viscosity)]

MR viscosity (at −35° C.) of each of the synthetic oil-containing lubricating oil compositions to be prepared in Examples 1 to 9 and Comparative Examples 1 to 4 is measured in accordance with ASTM D4648.

When lubricating oil compositions are produced at compositions adjusted to achieve approximately the same kinematic viscosity at 100° C., and compared between the lubricating oil compositions, a lubricating oil composition with a lower MR viscosity has better oil pumping properties at a low temperature.

Descriptions will be given below regarding Examples 1 to 9 and Comparative Examples 1 to 4. It is noted that there are cases where polymerization is performed for a plurality of times in order to secure an enough amount of copolymer to perform the analysis and to evaluate each viscosity modifier.

[Production Example 1]4-Methyl-1-Pentene/Propylene Copolymer (A1)

To a sufficiently nitrogen-substituted SUS autoclave having a capacity of 1.5 litres and equipped with a stirring blade, 750 ml of 4-methyl-1-pentene was introduced at 23° C. To the autoclave, 0.75 ml of a 1.0 mmol/ml toluene solution of triisobutylaluminum (TIBAL) was introduced, and the stirrer was turned on.

Next, the autoclave was heated to an internal temperature of 60° C., and pressurized with propylene to a total pressure of 0.13 MPa (gauge pressure). Subsequently, 0.34 ml of a previously prepared toluene solution containing 1 mmol in terms of A1 of methylaluminoxane and 0.01 mmol of diphenylmethylene(1-ethyl-3-t-butyl-cyclopentadienyl)(2,7-di-t-butyl-fluorenyl)zirconium dichloride was injected into the autoclave with nitrogen, to initiate polymerization. During the polymerization reaction, the temperature was controlled such that the internal temperature of the autoclave was maintained at 60° C. Sixty minutes after the start of the polymerization, 5 ml of methanol was injected into the autoclave with nitrogen to terminate the polymerization, followed by depressurizing the autoclave to atmospheric pressure. To a resulting reaction solution, acetone was poured with stirring.

A resulting polymer in the form of a powder containing solvents was dried under reduced pressure at 100° C. for 12 hours. The amount of the thus obtained polymer (4-methyl-1-pentene/propylene copolymer: A1) was 36.9 g. The measurement results of the physical properties of the polymer are shown in Table 2.

[Production Example 2]
4-Methyl-1-Pentene/Propylene Copolymer (A2)

To a sufficiently nitrogen-substituted SUS autoclave having a capacity of 1.5 litres and equipped with a stirring blade, 750 ml of 4-methyl-1-pentene was introduced at 23° C. To the autoclave, 0.75 ml of a 1.0 mmol/ml toluene solution of triisobutylaluminum (TIBAL) was introduced, and the stirrer was turned on.

Next, the autoclave was heated to an internal temperature of 60° C., and pressurized with propylene to a total pressure of 0.4 MPa (gauge pressure). Subsequently, 0.34 ml of a previously prepared toluene solution containing 1 mmol in terms of A1 of methylaluminoxane and 0.01 mmol of diphenylmethylene(1-ethyl-3-t-butyl-cyclopentadienyl)(2,7-di-t-butyl-fluorenyl)zirconium dichloride was injected into the autoclave with nitrogen, to initiate polymerization. During the polymerization reaction, the temperature was controlled such that the internal temperature of the autoclave was maintained at 60° C. Thirty minutes after the start of the polymerization, 5 ml of methanol was injected into the autoclave with nitrogen to terminate the polymerization, followed by depressurizing the autoclave to atmospheric pressure. To a resulting reaction solution, acetone was poured with stirring.

A resulting polymer in the form of a powder containing solvents was dried under reduced pressure at 100° C. for 12 hours. The amount of the thus obtained polymer (4-methyl-1-pentene/propylene copolymer: A2) was 69.0 g.

[Production Example 3]
4-Methyl-1-Pentene/Propylene Copolymer (A3)

To a sufficiently nitrogen-substituted SUS autoclave having a capacity of 1.5 litres and equipped with a stirring blade, 750 ml of 4-methyl-1-pentene was introduced at 23° C. To the autoclave, 0.75 ml of a 1.0 mmol/ml toluene solution of triisobutylaluminum (TIBAL) was introduced, and the stirrer was turned on.

Next, the autoclave was heated to an internal temperature of 60° C., and pressurized with propylene to a total pressure of 0.45 MPa (gauge pressure). Subsequently, 0.34 ml of a previously prepared toluene solution containing 1 mmol in terms of A1 of methylaluminoxane and 0.01 mmol of diphenylmethylene(1-ethyl-3-t-butyl-cyclopentadienyl)(2,7-di-t-butyl-fluorenyl)zirconium dichloride was injected into the autoclave with nitrogen. After adding 50 Nml of hydrogen as a molecular weight regulator, polymerization was initiated. During the polymerization reaction, the temperature was controlled such that the internal temperature of the autoclave was maintained at 60° C. Five minutes after the start of the polymerization, 5 ml of methanol was injected into the autoclave with nitrogen to terminate the polymerization, followed by depressurizing the autoclave to atmospheric pressure. To a resulting reaction solution, acetone was poured with stirring.

A resulting polymer in the form of a powder containing solvents was dried under reduced pressure at 100° C. for 12 hours. The amount of the thus obtained polymer (4-methyl-1-pentene/propylene copolymer: A3) was 26.1 g.

[Production Example 11]
4-Methyl-1-Pentene/Propylene Copolymer (A11)

(8-Octamethylfluoren-12'-yl-(2-(adamantan-1-yl)-8-methy 1-3,3b,4,5,6,7,7a,8-octahydrocyclopenta[a]indene)) zirconium dichloride was synthesized, in accordance with the method described in Synthesis Example 4 in WO 2014/050817. This compound is hereinafter also referred to as the "catalyst (a)".

A magnetic stirring bar was placed in a sufficiently dried and nitrogen-substituted Schlenk tube. To the Schlenk tube, 10.8 μmol of the catalyst (a) as a metallocene compound was introduced, and then a suspension of modified methylaluminoxane in an amount of 300 equivalents (n-hexane solvent; 3.24 mmol in terms of aluminum atom) with respect to the amount of the catalyst (a) was added with stirring at room temperature. Subsequently, heptane was added in such an amount that the concentration of the catalyst (a) was 1 μmol/mL, to give a catalyst liquid.

To a sufficiently nitrogen-substituted SUS autoclave having a capacity of 1.5 litres and equipped with a stirring blade, 750 ml of 4-methyl-1-pentene was introduced at 23° C. To the autoclave, 0.75 ml of a 1.0 mmol/ml toluene solution of triisobutylaluminum (TIBAL) was introduced, and the stirrer was turned on.

Next, the autoclave was heated to an internal temperature of 80° C., and pressurized with propylene to a total pressure of 0.5 MPa (gauge pressure). Subsequently, 5.0 mL of the catalyst liquid prepared above and 5.0 mL of heptane were mixed and then injected into the autoclave with nitrogen, to initiate polymerization. During the polymerization reaction, the temperature was controlled such that the internal temperature of the autoclave was maintained at 80° C. Eight minutes after the start of the polymerization, 5 ml of methanol was injected into the autoclave with nitrogen to terminate the polymerization, followed by depressurizing the autoclave to atmospheric pressure. To a resulting reaction solution, acetone was poured with stirring.

A resulting polymer containing solvents was dried under reduced pressure at 100° C. for 12 hours. The amount of the thus obtained polymer (4-methyl-1-pentene/propylene copolymer: A11) was 66.4 g. The measurement results of the physical properties of the polymer are shown in Table 2.

[Production Example 4]
4-Methyl-1-Pentene/Ethylene Copolymer (A4)

A magnetic stirring bar was placed in a sufficiently dried and nitrogen-substituted Schlenk tube. To the Schlenk tube, 10.8 μmol of the catalyst (a) as a metallocene compound was introduced, and then a suspension of modified methylaluminoxane in an amount of 300 equivalents (n-hexane solvent; 3.24 mmol in terms of aluminum atom) with respect to the amount of the catalyst (a) was added with stirring at room temperature. Subsequently, heptane was added in such an amount that the concentration of the catalyst (a) was 1 μmol/mL, to give a catalyst liquid.

To a sufficiently dried and nitrogen-substituted SUS autoclave with a capacity of 1,500 ml, 750 mL of 4-methyl-1-pentene and 1.5 mL of a hexane solution of triisobutylaluminum (A1=0.5 M, 0.75 mmol) were introduced. Subsequently, a resulting mixture was heated to a polymerization temperature of 70° C. while stirring at 850 rotations/min. After adding 142 NmL of hydrogen at that temperature, nitrogen was added thereto until the internal pressure of the autoclave reached 0.25 MpaG. Further, the autoclave was pressurized with ethylene to a total pressure of 0.6 MpaG.

A quantity of 0.2 mL of the catalyst liquid prepared above and 2.8 mL of heptane were mixed and introduced into the autoclave to initiate polymerization, and ethylene was continuously supplied to the autoclave so as to maintain a total pressure of 0.6 MPaG until the polymerization was terminated. Twenty minutes after the start of the polymerization, methanol was added to the autoclave to terminate the polymerization.

A resulting polymerization liquid was taken out from the autoclave which had been cooled and depressurized, and then introduced into methanol to allow a polymer to precipitate. A resulting precipitated polymer was collected by filtration. Thereafter, the collected polymer was dried under reduced pressure at 80° C. for 12 hours, to give 74.1 g of a 4-methyl-1-pentene/ethylene copolymer (A4).

[Production Example 5]
4-Methyl-1-Pentene/Ethylene Copolymer (A5)

A magnetic stirring bar was placed in a sufficiently dried and nitrogen-substituted Schlenk tube. To the Schlenk tube, 33.6 μmol of the catalyst (a) as a metallocene compound was introduced, and then a suspension of modified methylaluminoxane in an amount of 300 equivalents (n-hexane solvent; 10.1 mmol in terms of aluminum atom) with respect to the amount of the catalyst (a) was added with stirring at room temperature. Subsequently, heptane was added in such an amount that the concentration of the catalyst (a) was 1 μmol/mL, to give a catalyst liquid.

To a sufficiently dried and nitrogen-substituted SUS autoclave with a capacity of 1,500 ml, 750 mL of 4-methyl-1-pentene and 1.5 mL of a hexane solution of triisobutylaluminum (A1=0.5 M, 0.75 mmol) were introduced. Subsequently, a resulting mixture was heated to a polymerization temperature of 70° C. while stirring at 850 rotations/min. After adding 142 NmL of hydrogen at that temperature, nitrogen was added thereto until the internal pressure of the autoclave reached 0.2 MpaG. Further, the autoclave was pressurized with ethylene to a total pressure of 0.6 MpaG.

A quantity of 0.2 mL of the catalyst liquid prepared above and 2.8 mL of heptane were mixed and introduced into the autoclave to initiate polymerization, and ethylene was continuously supplied to the autoclave so as to maintain a total pressure of 0.6 MPaG until the polymerization was terminated. Fifteen minutes after the start of the polymerization, methanol was added to the autoclave to terminate the polymerization.

A resulting polymerization liquid was taken out from the autoclave which had been cooled and depressurized, and then introduced into methanol to allow a polymer to precipitate. The precipitated polymer was collected by filtration. Thereafter, the collected polymer was dried under reduced pressure at 80° C. for 12 hours, to give 51.4 g of a 4-methyl-1-pentene/ethylene copolymer (A5).

[Production Example 6]
4-Methyl-1-Pentene/Ethylene Copolymer (A6)

A magnetic stirring bar was placed in a sufficiently dried and nitrogen-substituted Schlenk tube. To the Schlenk tube, 9.3 μmol of the catalyst (a) as a metallocene compound was introduced, and then a suspension of modified methylaluminoxane in an amount of 300 equivalents (n-hexane solvent; 2.78 mmol in terms of aluminum atom) with respect to the amount of the catalyst (a) was added with stirring at room temperature. Subsequently, heptane was added in such an amount that the concentration of the catalyst (a) was 1 μmol/mL, to give a catalyst liquid.

To a sufficiently dried and nitrogen-substituted SUS autoclave with a capacity of 1,500 ml, 750 mL of 4-methyl-1-pentene and 1.5 mL of a hexane solution of triisobutylaluminum (A1=0.5 M, 0.75 mmol) were introduced. Subsequently, a resulting mixture was heated to a polymerization temperature of 70° C. while stirring at 850 rotations/min. After adding 142 NmL of hydrogen at that temperature, nitrogen was added thereto until the internal pressure of the autoclave reached 0.3 MpaG. Further, the autoclave was pressurized with ethylene to a total pressure of 0.6 MpaG.

A quantity of 0.2 mL of the catalyst liquid prepared above and 2.8 mL of heptane were mixed and introduced into the autoclave to initiate polymerization, and ethylene was continuously supplied to the autoclave so as to maintain a total pressure of 0.6 MPaG until the polymerization was terminated. Twenty minutes after the start of the polymerization, methanol was added to the autoclave to terminate the polymerization.

A resulting polymerization liquid was taken out from the autoclave which had been cooled and depressurized, and then introduced into methanol to allow a polymer to precipitate. The precipitated polymer was collected by filtration. Thereafter, the collected polymer was dried under reduced pressure at 80° C. for 12 hours, to give 68.8 g of a 4-methyl-1-pentene/ethylene copolymer (A6).

[Production Example 12]
4-Methyl-1-Pentene/Ethylene Copolymer (A12)

A magnetic stirring bar was placed in a sufficiently dried and nitrogen-substituted Schlenk tube. To the Schlenk tube, 10.8 μmol of the catalyst (a) as a metallocene compound was introduced, and then a suspension of modified methylaluminoxane in an amount of 300 equivalents (n-hexane solvent; 3.24 mmol in terms of aluminum atom) with respect to the amount of the catalyst (a) was added with stirring at room temperature. Subsequently, heptane was added in such an amount that the concentration of the catalyst (a) was 1 μmol/mL, to give a catalyst liquid.

To a sufficiently dried and nitrogen-substituted SUS autoclave with a capacity of 4,000 ml, 1,950 mL of 4-methyl-1-pentene and 3.9 mL of a hexane solution of triisobutylaluminum (A1=0.5 M, 1.95 mmol) were introduced. Subsequently, a resulting mixture was heated to a polymerization temperature of 70° C. while stirring at 450 rotations/min. After adding 90.8 mL of hydrogen at that temperature, nitrogen was added thereto until the internal pressure of the autoclave reached 0.25 MpaG. Further, the autoclave was pressurized with ethylene to a total pressure of 0.6 MpaG.

A quantity of 0.5 mL of the catalyst liquid prepared above and 5.0 mL of heptane were mixed and introduced into the autoclave to initiate polymerization, and ethylene was continuously supplied to the autoclave so as to maintain a total pressure of 0.6 MPaG until the polymerization was terminated. Twenty minutes after the start of the polymerization, methanol was added to the autoclave to terminate the polymerization.

A resulting polymerization liquid was taken out from the autoclave which had been cooled and depressurized, and then introduced into methanol to allow a polymer to precipitate. The precipitated polymer was collected by filtration. Thereafter, the collected polymer was dried under reduced pressure at 80° C. for 12 hours, to give 81.1 g of a 4-methyl-1-pentene/ethylene copolymer (A12).

[Production Example 13]
4-Methyl-1-Pentene/Ethylene Copolymer (A13)

A magnetic stirring bar was placed in a sufficiently dried and nitrogen-substituted Schlenk tube. To the Schlenk tube, 10.8 μmol of the catalyst (a) as a metallocene compound was introduced, and then a suspension of modified methylaluminoxane in an amount of 300 equivalents (n-hexane solvent; 3.24 mmol in terms of aluminum atom) with respect to the amount of the catalyst (a) was added with stirring at room temperature. Subsequently, heptane was added in such an amount that the concentration of the catalyst (a) was 1 μmol/mL, to give a catalyst liquid.

To a sufficiently dried and nitrogen-substituted SUS autoclave with a capacity of 4,000 ml, 1,950 mL of 4-methyl-1-pentene and 3.9 mL of a hexane solution of triisobutylaluminum (A1=0.5 M, 1.95 mmol) were introduced. Subsequently, the resulting mixture was heated to a polymerization temperature of 70° C. while stirring at 450 rotations/min. After adding 90.8 mL of hydrogen at that temperature, nitrogen was added thereto until the internal pressure of the autoclave reached 0.18 MpaG. Further, the autoclave was pressurized with ethylene to a total pressure of 0.6 MpaG.

A quantity of 0.8 mL of the catalyst liquid prepared above and 5.0 mL of heptane were mixed and introduced into the autoclave to initiate polymerization, and ethylene was continuously supplied to the autoclave so as to maintain a total pressure of 0.6 MPaG until the polymerization was terminated. Twenty minutes after the start of the polymerization, methanol was added to the autoclave to terminate the polymerization.

A resulting polymerization liquid was taken out from the autoclave which had been cooled and depressurized, and then introduced into methanol to allow a polymer to precipitate. The precipitated polymer was collected by filtration. Thereafter, the collected polymer was dried under reduced pressure at 80° C. for 12 hours, to give 175.4 g of a 4-methyl-1-pentene/ethylene copolymer (A13).

[Production Example 7] Amorphous
Ethylene/Propylene Copolymer (EPR1)

An ethylene/propylene copolymer (EPR1) was produced according to the method described in Polymerization Example 6 in WO 2000/60032, except that the charged amount of hydrogen was changed from 90 mL to 150 mL, and the polymerization time was changed from five minutes to four minutes.

[Production Example 8] Amorphous
Ethylene/Propylene Copolymer (EPR2)

An ethylene/propylene copolymer (EPR2) was produced in the same manner as in Production Example 7, except that the charged amount of hydrogen was changed from 150 mL to 200 mL.

[Production Example 9] Crystalline
Ethylene/Propylene copolymer (EPR3)

A compound (1) represented by the following Formula and used as a catalyst was synthesized by a known method.

To a sufficiently nitrogen-substituted glass reactor with a capacity of 0.5 L, 250 ml of xylene was introduced. The reactor was then heated to 90° C., and ethylene and propylene were continuously supplied thereto at rates of 100 litre/hr and 16.8 litre/hr, respectively, while stirring the interior of the polymerization reactor at 600 rpm, thereby saturating the liquid phase and the gas phase. While continuing to supply ethylene and propylene, 6.0 mL (6.0 mmol) of a decane solution (1.0 mol/L) of triisobutylaluminum (also referred to as $iBu_3Al$), 7.5 mL (0.015 mmol) of a toluene solution (0.0020 mol/L) of the above described compound (1), and then 15.0 mL (0.06 mmol) of a toluene solution (4.0 mmol/L) of triphenylcarbenium tetrakis(pentafluorophenyl)borate (also referred to as $Ph_3CB(C_6F_5)_4$) were added to the reactor, and polymerization was carried out at 90° C. for 20 minutes under normal pressure. The polymerization was terminated by adding a small amount of isobutanol. A resulting polymerization reaction solution was washed with dilute hydrochloric acid, and the resulting organic layer obtained by liquid separation was concentrated. In order to remove catalyst residue components, the thus obtained concentrate was diluted with xylene, and the resultant was brought into contact with 20 g of an ion exchange resin (Amberlyst MSPS2-1 DRY, manufactured by Dow Chemical Company). After removing the ion exchange resin by filtration, a resulting solution was concentrated again, followed by drying under reduced pressure at 120° C. for 3 hours, to give a crystalline ethylene/propylene copolymer (EPR3).

[Chem. 2]

COMPOUND (1)

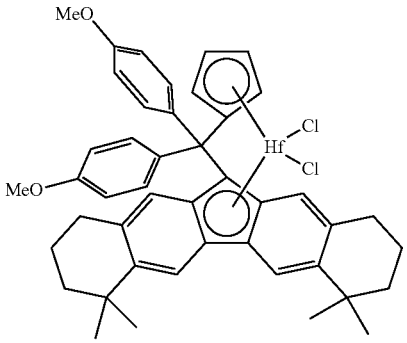

[Production Example 10] Crystalline Ethylene/Propylene Copolymer (EPR4)

To one of the feed ports of a sufficiently nitrogen-substituted pressurized continuous polymerization reactor having a capacity of 136 L and equipped with a stirring blade, dehydrated and purified n-hexane was supplied at a flow rate of 21.0 L/hour; and a hexane solution of methylaluminoxane (MMAO-3A; manufactured by Tosoh Finechem Corporation) prepared at a concentration of 2.0 mmol/L, a hexane solution of [dimethyl(t-butylamido)(tetramethyl-$\eta^5$-cyclopentadienyl)silane]titanium dichloride prepared at a concentration of 0.3 mmol/L, and a hexane solution of triphenylcarbenium tetrakis(pentafluorophenyl) borate prepared at a concentration of 0.05 mmol/L were supplied continuously at flow rates of 5.0 L/hour, 0.15 L/hour, and 1.0 L/hour, respectively (6.15 L/hour in total). Simultaneously, to another feed port of the continuous polymerization reactor, ethylene was supplied at a flow rate of 6.1 kg/hour, propylene was supplied at a flow rate of 5.6 kg/hour, and hydrogen was supplied at a flow rate 40 NL/hour, continuously. Subsequently, continuous solution polymerization was performed under conditions of a polymerization temperature of 120° C., a total pressure of 3.4 MPa-G (G=gauge pressure), and a stirring rotation speed of 256 rpm. A coolant was allowed to flow into a jacket provided on the outer periphery of the polymerization reactor. Further, a separately provided gas blower was used to forcibly circulate the gas phase portion, followed by cooling the gas phase by a heat exchanger, to remove the heat generated by the polymerization reaction.

A resulting hexane solution containing an ethylene/propylene copolymer produced by performing the polymerization under the above described conditions, was continuously discharged, thorough a discharge port provided at the lowermost portion of the polymerization reactor at a rate of 6.5 kg/hour as the ethylene/propylene copolymer, such that the average amount of solution within the polymerization reactor was maintained at 30 L. The resulting polymerization solution was introduced into a large amount of methanol, to allow the ethylene/propylene copolymer to precipitate. Thereafter, the precipitated ethylene/propylene copolymer was dried under reduced pressure at 130° C. for 24 hours, to give an ethylene/propylene copolymer (EPR4).

The evaluation results are shown in Table 2.

TABLE 2

| | | | | Composition | | | Thermal physical properties | | Molecular weight, Distribution Mw | | |
|---|---|---|---|---|---|---|---|---|---|---|---|
| | | | [η] dl/g | C2 mol % | C3 mol % | 4MP-1 mol % | Tg ° C. | Tm ° C. | In terms of PS | Mw/Mn — | Density kg/m$^3$ |
| 4MP-1/C3 | Production Example 1 | A1 | 1.5 | — | 28 | 72 | 15 | — | 316000 | 2.1 | 839 |
| | Production Example 2 | A2 | 1.6 | — | 38 | 62 | 14 | — | 325000 | 2.1 | 842 |
| | Production Example 3 | A3 | 1.2 | — | 36 | 64 | 15 | — | 226000 | 2.1 | 841 |
| | Production Example 11 | A11 | 2.1 | — | 23 | 77 | 17 | 109 | 400000 | 2.0 | 840 |
| 4MP-1/C2 | Production Example 4 | A4 | 1.2 | 22 | — | 78 | 0 | — | 235000 | 2.2 | 841 |
| | Production Example 5 | A5 | 1.2 | 26 | — | 74 | −4 | — | 243000 | 2.1 | 842 |
| | Production Example 6 | A6 | 1.6 | 19 | — | 81 | 3 | — | 364000 | 2.3 | 841 |
| | Production Example 12 | A12 | 2.4 | 26 | — | 74 | −4 | — | 670000 | 2.1 | 842 |
| | Production Example 13 | A13 | 2.2 | 25 | — | 75 | −4 | — | 590000 | 2.0 | 842 |
| Amorphous EPR | Production Example 7 | EPR1 | 1.7 | 53 | 47 | — | −57 | — | 213000 | 2.3 | 853 |
| | Production Example 8 | EPR2 | 1.2 | 55 | 45 | — | −59 | — | 139000 | 2.1 | 852 |
| Crystalline EPR | Production Example 9 | EPR3 | 1.1 | 79 | 21 | — | −55 | 26 | 110000 | 2.1 | 889 |
| | Production Example 10 | EPR4 | 0.8 | 78 | 22 | — | −54 | 27/45 | 75000 | 2.2 | 863 |

Examples 1 to 9 and Comparative Examples 1 to 4

The respective copolymers, obtained in the above described Production Examples were used as viscosity modifiers for lubricating oils, to give respective lubricating oil compositions. In each lubricating oil composition, the amounts of each copolymer, etc. to be added were adjusted such that the kinematic viscosity at 100° C. of the composition is around 10 $mm^2/s$, specifically, within the range of 10±0.2 $mm^2/s$. The evaluation results are shown in Table 3.

TABLE 3

| | | Copolymer | Added amount of Copolymer wt % | SSI % | KV @ 100° C. $mm^2/s$ | CCS @ −30° C. mPa · s | MRV @ −35° C. mPa · s |
|---|---|---|---|---|---|---|---|
| 4MP-1/C3 | Example 1 | A1 | 0.77 | 69 | 9.9 | 4030 | 9060 |
| | Example 2 | A2 | 0.73 | 69 | 9.9 | 4070 | 10600 |
| | Example 3 | A3 | 0.96 | 58 | 9.9 | 4160 | 9690 |
| | Example 4 | A11 | 0.65 | 72 | 10.0 | 3740 | 11160 |
| 4MP-1/C2 | Example 5 | A4 | 0.97 | 60 | 10.0 | 4190 | 14400 |
| | Example 6 | A5 | 0.94 | 59 | 10.0 | 4270 | 13500 |
| | Example 7 | A6 | 0.77 | 70 | 10.0 | 4090 | 10300 |
| | Example 8 | A12 | 0.49 | 83 | 9.9 | 3950 | 18800 |
| | Example 9 | A13 | 0.55 | 81 | 10.0 | 3890 | 17100 |
| Amorphous EPR | Comparative Example 1 | EPR1 | 0.61 | 44 | 10.0 | 4160 | 14500 |
| | Comparative Example 2 | EPR2 | 0.78 | 29 | 9.8 | 4310 | 13600 |
| Crystalline EPR | Comparative Example 3 | EPR3 | 0.85 | 20 | 10.0 | 3780 | 13800 |
| | Comparative Example 4 | EPR4 | 1.15 | 8 | 9.8 | 3920 | 14400 |

Examples 10 TO 18

The respective copolymers, obtained in the above described Production Examples were used as viscosity modifiers for lubricating oils, to give respective lubricating oil compositions. First, each copolymer and an oil were blended at a mass ratio of 10:90, to give a so-called concentrate. Next, the base oil, the additive and the pour point depressant described in the section of "Preparation of Mineral Oil-containing Lubricating Oil Composition" were added, at the composition shown therein, to dilute the concentrate, to give each lubricating oil composition having a kinematic viscosity at 100° C. of around 10 $mm^2/s$. It was confirmed that each of the finally obtained lubricating oil compositions has physical properties equivalent to those of the lubricating oil compositions of Examples 1 to 9.

Comparison Between Examples 1 to 9 and Comparative Examples 1 to 4

It can be seen from the results that the lubricating oil compositions of Examples have a lower MRV (namely, better oil pumping properties at a low temperature) as compared to the lubricating oil compositions of Comparative Examples. In particular, the lubricating oil compositions of Examples 1 to 3 and 7, each containing the resin (A) whose Tg is within the preferred range, have an excellent MRV. Further, the lubricating oil compositions of Examples also tend to have a lower CCS (namely, a better low temperature startability) as compared to the lubricating oil compositions of Comparative Examples land 2, each prepared using a conventional amorphous polymer. In addition, it can be expected that the lubricating oil compositions of Examples have an excellent low temperature storage stability, due to containing amorphous copolymers.

In the following Example 19 and Comparative Examples 5 and 6, respective physical properties were measured and evaluated by the methods described below.

[DSC Measurement]

DSC measurement of each of the polymers produced in Example 19 and Comparative Examples 5 and 6 is carried out using a differential scanning calorimeter (X-DSC7000) manufactured by Seiko Instruments Inc. and calibrated with indium standard.

About 10 mg of the above described measurement sample is weighed into a DSC pan made of aluminum. A cover is crimped to the pan and the sample is left in a closed atmosphere, to give a sample pan.

The sample pan is disposed in a DSC cell, and an empty aluminum pan is placed as a reference. The temperature of the DSC cell is increased from 30° C. (room temperature) to 150° C. at a rate of 10° C./min under a nitrogen atmosphere (a first heating process).

After maintaining at 150° C. for 5 minutes, the temperature is decreased at a rate of 10° C./min to cool the DSC cell to −100° C. (cooling process). After maintaining at −100° C. for 5 minutes, the temperature is increased at a rate of 10° C./min to heat the DSC cell to 150° C. (a second heating process).

The peak top temperature of the melting peak in an enthalpy curve obtained during the second heating process is defined as the melting point (Tm). In cases where two or more melting peaks are observed, the peak top temperature of the highest peak is defined as the Tm. Further, the heat of fusion (ΔH) was calculated from the integral value of the crystal melting peak.

[GPC Measurement]

Weight average molecular weight and the molecular weight distribution of each of the polymers used in Example 19 and Comparative Examples 5 and 6 are measured according to the following methods.

(Pre-Treatment of Sample)

A quantity of 30 mg of each of the polymers used in Example 19 and Comparative Examples 5 and 6 is dissolved in 20 ml of o-dichlorobenzene at 145° C., and a resulting solution is then filtered through a sintered filter having a pore diameter of 1.0 μm. The resulting filtrate is used as an analysis sample.

(GPC Analysis)

Weight average molecular weight (Mw), number average molecular weight (Mn), and molecular weight distribution curve of the analysis sample are determined using gel permeation chromatography (GPC). The calculations are carried out in terms of polystyrene. Mw/Mn is calculated from the thus determined weight average molecular weight (Mw) and number average molecular weight (Mn).

(Measuring Apparatus)

Gel permeation chromatograph, HLC-8321, Type GPC/HT (manufactured by Tosoh Corporation)

(Analysis Apparatus)

Data processing software, Empower 2 (registered trademark, manufactured by Waters Corporation)

(Measurement Conditions)

Columns: two TSKgel $GMH_6$-HT columns, and two TSKgel $GMH_6$-HTL columns (each having a diameter of 7.5 mm and a length of 30 cm, manufactured by Tosoh Corporation)

Column temperature: 140° C.

Mobile phase: o-dichlorobenzene (containing 0.025% BHT)

Detector: differential refractometer

Flow rate: 1 mL/min

Sample concentration: 0.15% (w/v)

Injection volume: 0.4 mL

Sampling time interval: 1 second

Column calibration: monodisperse polystyrene (manufactured by Tosoh Corporation)

Molecular weight conversion: PS conversion/standard conversion method

[Contents of Structural Units and Evaluation of Isotactic Dyad Fraction]

The contents of the structural units (% by mole) derived from 4-methyl-1-pentene, ethylene and α-olefins in each of the polymers used in Example 19 and Comparative Examples 5 and 6, and the isotactic dyad fraction of each polymer, are determined by $^{13}C$-NMR spectral analysis.

(Measuring Apparatus)

AVANCE III 500 CryoProbe Prodigy nuclear magnetic resonance apparatus, manufactured by Bruker BioSpin GmbH.

(Measurement Conditions)

Nucleus measured: $^{13}C$ (125 MHz); Measurement mode: single pulse proton broadband decoupling; Pulse width: 45° (5.00 μsec); Number of points: 64 k; Measurement range: 250 ppm (−55 to 195 ppm); Repetition time: 5.5 sec; Number of scans: 512 times; Solvent for measurement: o-dichlorobenzene/benzene-$d_6$ (4/1 v/v); Sample concentration: ca. 60 mg/0.6 mL; Measurement temperature: 120° C.; Window function: exponential (BF: 1.0 Hz); and Chemical shift reference: benzene-$d_6$ (128.0 ppm).

Preparation of Mineral Oil-containing Lubricating Oil Composition

An engine oil (lubricating oil composition) containing each of the viscosity modifiers for lubricating oils obtained in Example 19 and Comparative Examples 5 and 6 is prepared. The lubricating oil composition contains the following components:

API group III base oil: from 90.22 to 90.94 (% by mass)

Additive*: 8.15 (% by mass)

Pour point depressant (polymethacrylate): 0.3 (% by mass)

Copolymer: from 0.61 to 1.33 (as shown in Table 4) (% by mass)

Total: 100.0 (% by mass)

Note: *additive=a conventional additive package for engine lubricating oils, including: Ca and Na overbased detergents; N-containing dispersant; aminic and phenolic antioxidants; zinc dialkyldithiophosphate; friction modifier; and antifoaming agent.

[Shear Stability Index (SSI)]

SSI of each of the mineral oil-containing lubricating oil compositions to be prepared in Example 19 and Comparative Examples 5 and 6 is measured by the ultrasonic wave method referencing JPI-5S-29-88. Each of the lubricating oil compositions is irradiated with ultrasonic waves, and the SSI is determined from the rate of decrease in kinematic viscosity before and after the irradiation. The SSI is a measure of a decrease in kinematic viscosity resulting from the breakage of molecular chains when the copolymer components in the lubricating oil are subjected to shear under sliding conditions. A higher SSI value indicates a larger decrease in kinematic viscosity.

(Measuring Apparatus)

US-300TCVP ultrasonic wave shear stability tester (manufactured by PrimeTech Ltd.)

(Measurement Conditions)

Oscillatory frequency: 10 KHz

Test temperature: 40° C.

Position of irradiation horn: 2 mm below the liquid level (Measurement Method)

A quantity of 30 ml of sample is collected and placed into a sample container, and the container is then irradiated with ultrasonic waves at an output voltage of 4.2 V for 30 minutes. The kinematic viscosity at 100° C. of the sample oil is measured before and after the irradiation of ultrasonic waves, and the SSI is determined according to the formula shown below:

$$SSI\ (\%)=100\times(Vo-Vs)/(Vo-Vb)$$

Vo: kinematic viscosity ($mm^2/s$) at 100° C. before ultrasonic irradiation

Vs: kinematic viscosity ($mm^2/s$) at 100° C. after ultrasonic irradiation

Vb: kinematic viscosity ($mm^2/s$) at 100° C. of the engine oil (lubricating oil composition) in which the component amount of the viscosity modifier for lubricating oils is adjusted to 0% by mass In general, a lubricating oil composition having a lower SSI value shows a relatively smaller decrease in kinematic viscosity, but tends to have a relatively higher ratio of the viscosity modifier with respect to the blending ratio. On the other hand, a lubricating oil composition having a higher SSI value shows a relatively larger decrease in kinematic viscosity, but tends to have a relatively lower ratio of the viscosity modifier with respect to the blending ratio.

Since the amount of a viscosity modifier used for obtaining a lubricating oil composition has a large impact on the cost of producing the lubricating oil composition, lubricating oil compositions varying in SSI value are produced and are commercially available, in general, so that they can be selected depending on the required level of decrease in kinematic viscosity.

Therefore, when discussing the superiority and inferiority of the fuel saving performance of lubricating oil compositions, it is reasonable to compare between lubricating oil compositions having approximately the same SSI values.

[Kinematic Viscosity (KV)]

Kinematic viscosity at 100° C. of each of the lubricating oil compositions to be prepared in Example 19 and Comparative Examples 5 and 6 is measured in accordance with ASTM D446.

[Cold Cranking Simulator (CCS) Viscosity]

CCS viscosity (at −30° C.) of each of the mineral oil-containing lubricating oil compositions to be prepared in Example 19 and Comparative Examples 5 and 6 is measured in accordance with ASTM D2602. The CCS viscosity is used to evaluate the slidability (startability) of a crank shaft at a low temperature. A lower value indicates a better low temperature viscosity (low temperature properties) of the lubricating oil.

When lubricating oil compositions are produced at compositions adjusted to achieve approximately the same kinematic viscosity at 100° C., and compared between the lubricating oil compositions having approximately the same SSI, a lubricating oil composition with a lower CCS viscosity has a better fuel saving performance at a low temperature (low temperature startability).

[Mini-Rotary Viscosity (MRV, MR viscosity)]

MR viscosity (at −35° C.) of each of the mineral oil-containing lubricating oil compositions to be prepared in Example 19 and Comparative Examples 5 and 6 is measured in accordance with ASTM D4648.

When lubricating oil compositions are produced at compositions adjusted to achieve approximately the same kinematic viscosity at 100° C., and compared between the lubricating oil compositions, a lubricating oil composition with a lower MR viscosity has better oil pumping properties at a low temperature.

Example 19

A 4-methyl-1-pentene/α-olefin copolymer was obtained in accordance with the polymerization method described in Example 1 in WO 2006/109631. As α-olefins, a mixture of 1-hexadecene and 1-octadecene mixed at a ratio of 57:43 was used. Subsequently, a resulting polymer was purified. Specifically, 270 mL of n-hexane was added to 30 g of the resulting polymer, and the resultant was heated at 60° C. for one hour to dissolve the polymer. Thereafter, the insoluble component was separated by filtration. The resulting filtrate was introduced into acetone in an amount about three times the amount of filtrate, and the component dissolved in n-hexane was allowed to precipitate. The precipitates were separated by filtration, and then dried, to give a polymer (A-1). The analysis results and the evaluation results of a lubricating oil composition prepared using the thus obtained polymer (A-1) as a viscosity modifier for lubricating oils, are shown in Table 4.

Comparative Example 5

An ethylene/propylene copolymer (EPR-1) was produced according to the method described in Polymerization Example 6 in WO 2000/60032, except that the charged amount of hydrogen was changed from 90 mL to 200 mL, and the polymerization time was changed from 5 minutes to 4 minutes. The evaluation results of the thus obtained polymer and a lubricating oil composition prepared using the polymer as a viscosity modifier for lubricating oils are shown in Table 4.

Comparative Example 6

An ethylene/propylene copolymer (EPR-2) was produced in the same manner as in Comparative Example 1, except that the charged amount of hydrogen was changed from 200 mL to 150 mL. The evaluation results of the thus obtained polymer and a lubricating oil composition prepared using the polymer as a viscosity modifier for lubricating oils are shown in Table 4.

Comparison Between Example 19 and Comparative Examples 5 and 6

It can be seen from the results that the lubricating oil composition of the Example 19 has a lower CCS viscosity (−30° C.) and a lower MR viscosity (−35° C.), namely, better low temperature properties, as compared to the lubricating oil compositions of the Comparative Examples 5 and 6.

TABLE 4

| | | Example 19 | Comparative Example 5 | Comparative Example 6 |
|---|---|---|---|---|
| Composition and physical properties of copolymer | Name of copolymer | A-1 | EPR-1 | EPR-2 |
| | Structural unit derived from 4-methyl-1-pentene (mol %) | 92.1 | 0 | 0 |
| | Structural units derived from 1-hexadecene and 1-octadecene (mol %) | 7.9 | 0 | 0 |
| | Structural unit derived from ethylene (mol %) | 0 | 55 | 52 |
| | Structural unit derived from propylene (mol %) | 0 | 45 | 48 |
| | Tm (° C.) | 167 | Not detected | Not detected |
| | ΔH (J/g) | 12 | — | — |
| | Weight average molecular weight (Mw) | 263000 | 143000 | 215000 |
| | Mw/Mn | 6.4 | 2.0 | 2.2 |
| | Isotactic dyad fraction (%) | 88.9 | No data available | No data available |
| Physical properties of lubricating oil composition | Added amount of viscosity modifier (copolymer) [wt %] | 1.33 | 0.78 | 0.61 |
| | Kinematic viscosity @ 100° C. [$mm^2/s$] | 9.93 | 9.80 | 9.97 |
| | SSI [%] | 41 | 29 | 44 |
| | CCS viscosity @ −30° C. [mPa · s] | 4190 | 4310 | 4160 |
| | MR viscosity @ −35° C. [mPa · s] | 12000 | 13600 | 14500 |

INDUSTRIAL APPLICABILITY

The viscosity modifier for lubricating oils and the additive composition for lubricating oils according to the present invention can be suitably used to obtain a lubricating oil composition excellent in viscosity characteristics at a low temperature.

The lubricating oil composition according to the present invention has a reduced low temperature viscosity, namely, excellent low temperature viscosity characteristics, and it can be used, for example, as a lubricating oil for gasoline engines, a lubricating oil for diesel engines, a lubricating oil for marine vessel engines, a lubricating oil for two-stroke engines, a lubricating oil for automatic or manual transmissions, a lubricating oil for gears, or grease.

The invention claimed is:

1. A lubricating oil composition comprising a resin (Al) containing a polymer (A) and a base oil (B), wherein the polymer (A) satisfies the following requirement (A-1):

(A-1) the polymer (A) contains a structural unit derived from 4-methyl-1-pentene in an amount within the range of from 30 to 90% by mole with respect to the total structural units and a structural unit derived from propylene or ethylene in an amount within the range of from 10 to 70% by mole with respect to the total structural units; and wherein the content ratio of the polymer (A) and the base oil (B) is such that the ratio of the polymer (A) is within the range of from 0.1 to 50 parts by mass with respect to 100 parts by mass of the total amount of the polymer (A) and the base oil (B);

wherein the resin (Al) satisfies the following requirements (A-2) to (A-4):

(A-2) the resin (Al) has an intrinsic viscosity [η] as measured in decalin at 135° C. of within the range of from 0.01 to 5.0 dl/g;

(A-3) the resin (Al) has a melting point (Tm) as measured by differential scanning calorimetry (DSC) of less than 110° C., or has no detected melting point (Tm); and (A-4) the resin (Al) has a glass transition temperature (Tg) as measured by differential scanning calorimetry (DSC) of within the range of from 1 to 50° C.;

wherein the base oil (B) satisfies the following requirement (B-1):

(B-1) the base oil (B) has a kinematic viscosity at 100° C. of within the range of from 1 to 50 $mm^2/s$; and wherein the content ratio of the resin (Al) and the base oil (B) is such that the ratio of the resin (Al) is within the range of from 0.1 to 50 parts by mass with respect to 100 parts by mass of the total amount of the resin (Al) and the base oil (B).

2. The lubricating oil composition according to claim 1, wherein, in the requirement (A-1), the polymer (A) contains the structural unit derived from propylene in an amount within the range of from 10 to 70% by mole with respect to the total structural units.

3. The lubricating oil composition according to claim 1, wherein, in the requirement (A-2), the intrinsic viscosity [η]as measured in decalin at 135° C. is within the range of from 0.1 to 2.5 dl/g.

4. The lubricating oil composition according to claim 1, wherein the content ratio of the resin (Al) and the base oil (B) is such that the ratio of the resin (Al) is within the range of from 1 to 50 parts by mass with respect to 100 parts by mass of the total amount of the resin (Al) and the base oil (B).

5. The lubricating oil composition according to claim 1, wherein the content ratio of the resin (Al) and the base oil (B) is such that the ratio of the resin (Al) is within the range of from 0.1 to 5 parts by mass with respect to 100 parts by mass of the total amount of the resin (Al) and the base oil (B).

6. A lubricating oil composition comprising a polymer (A) and a base oil (B), the lubricating oil composition comprising a viscosity modifier for lubricating oils containing the polymer (A), wherein the polymer (A) contains: from 65 to 99% by mole of a structural unit derived from 4-methyl-1-pentene; and from 1 to 35% by mole of a structural unit derived from at least one selected from ethylene and a-olefins having from 3 to 20 carbon atoms other than 4-methyl-1-pentene;

wherein the polymer (A) satisfies the following requirements (I) to (III):

(I) the polymer (A) has an isotactic dyad fraction as measured by $^3C$-NMR of within the range of from 40 to 95%;

(II) the polymer (A) has a weight average molecular weight (Mw) as measured by gel permeation chromatography (GPC) of within the range of from 50,000 to 500,000; and (III) the polymer (A) has a ratio (Mw/Mn) of the weight average molecular weight to the number average molecular weight as measured by gel permeation chromatography (GPC) of within the range of from 2.0 to 20.0; and wherein the content ratio of the polymer (A) and the base oil (B) is such that the ratio of a resin (A) is within the range of from 0.1 to 50 parts by mass with respect to 100 parts by mass of the total amount of the polymer (A) and the base oil (B).

7. The lubricating oil composition according to claim 6, wherein the base oil (B) is a lubricating oil base (BB); and wherein the lubricating oil composition comprises from 0.1 to 5 parts by mass of the viscosity modifier for lubricating oils; and from 95 to 99.9 parts by mass of the lubricating oil base (BB) (with the proviso that the total amount of the viscosity modifier for lubricating oils and the lubricating oil base (BB) is taken as 100 parts by mass).

8. The lubricating oil composition according to claim 1, further comprising from 0.05 to 5% by mass of a pour point depressant (C) in 100% by mass of the lubricating oil composition.

9. The lubricating oil composition according to claim 1, wherein the base oil (B) is a mineral oil.

10. The lubricating oil composition according to claim 1, wherein the base oil (B) is a synthetic oil.

11. A viscosity modifier for lubricating oils, comprising a polymer (A) satisfying the following requirements (A-1) to (A-4):

(A-1) the polymer (A) contains a structural unit derived from 4-methyl-1-pentene in an amount within the range of from 30 to 90% by mole with respect to the total structural units and a structural unit derived from propylene or ethylene in an amount within the range of from 10 to 70% by mole with respect to the total structural units;

(A-2) the polymer (A) has an intrinsic viscosity [η]as measured in decalin at 135° C. of within the range of from 0.01 to 5.0 dl/g;

(A-3) the polymer (A) has a melting point (Tm) as measured by differential scanning calorimetry (DSC) of less than 110° C., or is not detected; and (A-4) the polymer (A) has a glass transition temperature (Tg) as measured by differential scanning calorimetry (DSC) of within the range of from 1 to 50° C.

12. The viscosity modifier for lubricating oils according to claim 11, wherein, in the requirement (A-1), the polymer (A) contains the structural unit derived from propylene in an amount within the range of from 10 to 70% by mole with respect to the total structural units.

13. The viscosity modifier for lubricating oils according to claim 11, wherein, in the requirement (A-2), the intrinsic viscosity [η]as measured in decalin at 135° C. is within the range of from 0.1 to 2.5 dl/g.

14. A viscosity modifier for lubricating oils comprising a polymer (A), wherein the polymer (A) contains: from 65 to 99% by mole of a structural unit derived from 4-methyl-1-pentene; and from 1 to 35% by mole of a structural unit derived from at least one selected from ethylene and a-olefins having from 3 to 20 carbon atoms other than 4-methyl-1-pentene; and wherein the polymer (A) satisfies the following requirements (I) to (III):

(I) the polymer (A) has an isotactic dyad fraction as measured by $^{13}$C-NMR of within the range of from 40 to 95%;

(II) the polymer (A) has a weight average molecular weight (Mw) as measured by gel permeation chromatography (GPC) of within the range of from 50,000 to 500,000; and (III) the polymer (A) has a ratio (Mw/Mn) of the weight average molecular weight to the number average molecular weight as measured by gel permeation chromatography (GPC) of within the range of from 2.0 to 20.0.

15. The viscosity modifier for lubricating oils according to claim 11, wherein the polymer (A) is composed of: the structural unit derived from 4-methyl-1-pentene; and a structural unit derived from at least one selected from a-olefins having from 4 to 20 carbon atoms other than 4-methyl-1-pentene.

16. The viscosity modifier for lubricating oils according to claim 11, wherein the polymer (A) is composed of: the structural unit derived from 4-methyl-1-pentene; and a structural unit derived from at least one selected from a-olefins having from 6 to 18 carbon atoms other than 4-methyl-1-pentene.

17. The viscosity modifier for lubricating oils according to claim 11, wherein, in the requirement (I), the isotactic dyad fraction is within the range of from 50 to 90%.

18. The viscosity modifier for lubricating oils according to claim 11, wherein the polymer (A) satisfies the following requirements (IV) and (V):

(IV) the melting point (Tm) as measured by differential scanning calorimetry (DSC) is not observed, or is within the range of less than 220° C.; and (V) the heat of fusion (AH) as measured by differential scanning calorimetry (DSC) is within the range of from 0 to 20 J/g.

19. An additive composition for lubricating oils, comprising:

from 1 to 50 parts by mass of the viscosity modifier for lubricating oils according to claim 11;

and from 50 to 99 parts by mass of an oil (B2) (with the proviso that the total amount of the viscosity modifier for lubricating oils and the oil (B2) is taken as 100 parts by mass).

* * * * *